US007134575B2

(12) United States Patent
Vogel et al.

(10) Patent No.: US 7,134,575 B2
(45) Date of Patent: Nov. 14, 2006

(54) CLOSURE FOR A CONTAINER

(75) Inventors: William C. Vogel, Mequon, WI (US); Terrence M. Parve, Menomonee Falls, WI (US)

(73) Assignee: Gateway Plastics, Inc., Mequon, WI (US)

( * ) Notice: Subject to any disclaimer, the term of this patent is extended or adjusted under 35 U.S.C. 154(b) by 0 days.

(21) Appl. No.: 10/740,176

(22) Filed: Dec. 18, 2003

(65) Prior Publication Data

US 2004/0173645 A1 Sep. 9, 2004

Related U.S. Application Data

(60) Provisional application No. 60/435,482, filed on Dec. 21, 2002.

(51) Int. Cl.
*B65D 47/08* (2006.01)
*A47G 19/24* (2006.01)

(52) U.S. Cl. ..... 222/143; 222/546; 222/556; 222/565

(58) Field of Classification Search ..... 222/142.4, 222/143, 546, 556, 565
See application file for complete search history.

(56) References Cited

U.S. PATENT DOCUMENTS

| | | | | |
|---|---|---|---|---|
| 847,726 | A | 3/1907 | Brannon | |
| 1,820,817 | A * | 8/1931 | McRae | 215/307 |
| 2,102,440 | A | 12/1937 | Sebell | |
| 2,687,157 | A | 8/1954 | Cowan | |
| 2,778,533 | A | 1/1957 | Savary | |
| 2,826,343 | A | 3/1958 | Albiani | |
| 2,894,654 | A | 7/1959 | Lohrer | |
| 3,013,308 | A | 12/1961 | Armour | |
| 3,018,931 | A | 1/1962 | Westgate | |
| 3,033,407 | A | 5/1962 | Isele-Aregger | |
| D193,121 | S | 6/1962 | Wickman | |
| 3,059,816 | A | 10/1962 | Goldstein | |
| 3,110,410 | A | 11/1963 | Pehr | |
| 3,117,701 | A | 1/1964 | Stull | |
| 3,131,824 | A * | 5/1964 | Van Baarn | 222/153.07 |
| 3,135,456 | A | 6/1964 | Palazzolo | |
| 3,143,256 | A | 8/1964 | Lazure et al. | |
| 3,155,285 | A | 11/1964 | Van Baam | |
| D200,270 | S | 2/1965 | Waterman | |
| 3,180,537 | A * | 4/1965 | Collins | 222/480 |
| 3,181,746 | A | 5/1965 | Tupper | |

(Continued)

FOREIGN PATENT DOCUMENTS

| | | |
|---|---|---|
| CA | 1245601 | 11/1988 |

(Continued)

OTHER PUBLICATIONS

Cap of a type understood to be commercially available from Weatherchem Corporation (six photographs; one sheet). Admitted Prior Art.

(Continued)

*Primary Examiner*—Joseph A. Kaufman
(74) *Attorney, Agent, or Firm*—Foley & Lardner LLP

(57) ABSTRACT

A closure for a container having a body and a cover is disclosed. The body includes a base configured to be coupled to a receptacle, a top portion coupled to the base, a dispensing aperture in the top portion, and a recess extending around at least a portion of the periphery of the top portion. The top portion has a first contour, at least a portion of which is non-planar. The cover includes a bottom surface having a second contour and a skirt configured to be received within the recess in the top portion when the cover is in the closed position.

42 Claims, 31 Drawing Sheets

U.S. PATENT DOCUMENTS

| | | | | |
|---|---|---|---|---|
| D204,509 | S | | 4/1966 | Waterman |
| 3,262,606 | A | | 7/1966 | Waterman |
| 3,322,308 | A | | 5/1967 | Foster |
| 3,323,671 | A | | 6/1967 | Minarik, Jr. et al. |
| 3,351,242 | A | | 11/1967 | Lodding et al. |
| 3,412,890 | A | | 11/1968 | Rich |
| 3,499,588 | A | | 3/1970 | Bartilson et al. |
| 3,542,235 | A | | 11/1970 | Hidding |
| 3,563,426 | A | | 2/1971 | Bartilson |
| 3,629,901 | A | | 12/1971 | Wolf |
| 3,651,992 | A | | 3/1972 | Hazard |
| 3,675,812 | A | | 7/1972 | Foster |
| 3,782,583 | A | | 1/1974 | Abbey |
| 3,851,812 | A | | 12/1974 | Bittel |
| 3,860,135 | A | | 1/1975 | Yung et al. |
| 3,881,639 | A | | 5/1975 | Herip |
| 3,907,156 | A | | 9/1975 | Weatherhead, III |
| 3,912,128 | A | | 10/1975 | Ziemann et al. |
| 3,933,271 | A | | 1/1976 | McGhie |
| 3,948,415 | A | | 4/1976 | Debenham |
| 3,966,080 | A | | 6/1976 | Bittel |
| 3,998,354 | A | | 12/1976 | Song |
| 4,022,352 | A | | 5/1977 | Pehr |
| 4,029,202 | A | | 6/1977 | Lasich et al. |
| 4,040,595 | A | | 8/1977 | Tecco |
| 4,082,201 | A | | 4/1978 | Bittel |
| 4,106,672 | A | * | 8/1978 | Tecco et al. ..... 222/151 |
| 4,127,221 | A | | 11/1978 | Vere |
| 4,163,496 | A | | 8/1979 | Dogliotti |
| 4,170,315 | A | | 10/1979 | Dubach et al. |
| 4,177,932 | A | | 12/1979 | Cleevely |
| 4,183,457 | A | | 1/1980 | Loughley et al. |
| 4,223,814 | A | | 9/1980 | Sneider |
| 4,236,653 | A | | 12/1980 | Gach |
| 4,253,587 | A | | 3/1981 | Otterson |
| 4,274,563 | A | | 6/1981 | Otterson |
| 4,280,636 | A | | 7/1981 | Lewis |
| 4,284,200 | A | | 8/1981 | Bush et al. |
| 4,291,818 | A | | 9/1981 | Nozawa et al. |
| 4,308,979 | A | | 1/1982 | Otterson |
| 4,326,649 | A | | 4/1982 | Marino et al. |
| D265,060 | S | | 6/1982 | Blank |
| 4,334,639 | A | | 6/1982 | Gach |
| D266,390 | S | | 10/1982 | Haner |
| 4,359,171 | A | | 11/1982 | Lewis |
| 4,361,250 | A | | 11/1982 | Foster |
| 4,369,901 | A | | 1/1983 | Hidding |
| 4,403,712 | A | | 9/1983 | Wiesinger |
| 4,414,705 | A | | 11/1983 | Ostrowsky |
| D272,807 | S | | 2/1984 | Ruhl |
| 4,457,458 | A | | 7/1984 | Heinol |
| 4,489,864 | A | | 12/1984 | Davis |
| D276,981 | S | | 1/1985 | Cleevely |
| 4,503,991 | A | | 3/1985 | Joyce |
| D278,602 | S | | 4/1985 | Rosenstein |
| 4,533,058 | A | | 8/1985 | Uhlig |
| 4,538,731 | A | | 9/1985 | Cillario |
| 4,541,541 | A | | 9/1985 | Hickman et al. |
| 4,545,495 | A | | 10/1985 | Kinsley |
| 4,545,508 | A | | 10/1985 | Cribb, Jr. et al. |
| 4,573,600 | A | | 3/1986 | Dubach |
| 4,610,371 | A | | 9/1986 | Karkiewicz |
| 4,629,081 | A | | 12/1986 | McLaren |
| 4,648,528 | A | | 3/1987 | LaBarge et al. |
| 4,658,980 | A | | 4/1987 | Lindstrom |
| D291,411 | S | | 8/1987 | Crawford |
| 4,693,399 | A | | 9/1987 | Hickman et al. |
| D292,882 | S | | 11/1987 | Gross |
| 4,714,181 | A | | 12/1987 | Kozlowski et al. |
| 4,718,567 | A | | 1/1988 | LaVange |
| 4,723,693 | A | | 2/1988 | DeCoster |
| 4,724,977 | A | | 2/1988 | Cleevely et al. |
| 4,726,091 | A | | 2/1988 | Joyce |
| 4,730,731 | A | | 3/1988 | Allison |
| 4,733,794 | A | | 3/1988 | Kent |
| 4,735,334 | A | | 4/1988 | Abbott |
| 4,735,335 | A | | 4/1988 | Torterotot |
| 4,739,906 | A | | 4/1988 | LoTurco |
| 4,778,071 | A | | 10/1988 | Fillmore |
| 4,792,054 | A | | 12/1988 | Weidman |
| 4,793,501 | A | | 12/1988 | Beck |
| 4,793,502 | A | | 12/1988 | Beck |
| 4,813,560 | A | | 3/1989 | Begley |
| 4,823,995 | A | | 4/1989 | Lewis |
| 4,838,441 | A | | 6/1989 | Chernack |
| 4,848,612 | A | | 7/1989 | Beck |
| 4,854,473 | A | | 8/1989 | Dubach |
| 4,881,668 | A | | 11/1989 | Kitterman et al. |
| D305,206 | S | | 12/1989 | Hickman et al. |
| 4,898,292 | A | | 2/1990 | VerWeyst et al. |
| D306,701 | S | | 3/1990 | Beck |
| 4,915,268 | A | | 4/1990 | Lay et al. |
| 4,919,286 | A | | 4/1990 | Agbay, Sr. |
| 4,936,494 | A | | 6/1990 | Weidman |
| 4,940,167 | A | | 7/1990 | Fillmore et al. |
| 4,955,513 | A | | 9/1990 | Bennett |
| 4,984,716 | A | | 1/1991 | Beck |
| 4,993,606 | A | | 2/1991 | Bolen, Jr. et al. |
| D315,307 | S | | 3/1991 | Kanyer |
| 5,007,555 | A | | 4/1991 | Beck |
| 5,020,686 | A | | 6/1991 | Dutt |
| D318,778 | S | | 8/1991 | Fiore et al. |
| 5,042,658 | A | | 8/1991 | Tiramani et al. |
| 5,048,730 | A | | 9/1991 | Forsyth et al. |
| D320,746 | S | | 10/1991 | Bolen, Jr. et al. |
| D321,137 | S | | 10/1991 | Hofmann et al. |
| 5,067,624 | A | | 11/1991 | Thanisch |
| 5,083,671 | A | | 1/1992 | Hayes |
| 5,085,331 | A | | 2/1992 | Groya et al. |
| 5,115,931 | A | | 5/1992 | Dubach |
| 5,139,165 | A | | 8/1992 | Hara |
| 5,143,234 | A | | 9/1992 | Lohrman et al. |
| D331,877 | S | | 12/1992 | Robichaud et al. |
| D331,878 | S | | 12/1992 | Forsyth |
| 5,167,338 | A | | 12/1992 | Kick |
| 5,211,301 | A | | 5/1993 | Groya et al. |
| 5,219,100 | A | | 6/1993 | Beck et al. |
| D339,065 | S | | 9/1993 | Forsyth et al. |
| D340,187 | S | | 10/1993 | Forsyth |
| D340,188 | S | | 10/1993 | Forsyth |
| 5,249,695 | A | | 10/1993 | Luch et al. |
| 5,271,519 | A | | 12/1993 | Adams et al. |
| D346,958 | S | | 5/1994 | Olson |
| D347,974 | S | | 6/1994 | McBride |
| 5,330,082 | A | | 7/1994 | Forsyth |
| 5,339,993 | A | | 8/1994 | Groya et al. |
| 5,348,183 | A | | 9/1994 | Luch et al. |
| 5,356,017 | A | | 10/1994 | Rohr et al. |
| 5,377,882 | A | | 1/1995 | Pham et al. |
| 5,383,582 | A | | 1/1995 | Baxter et al. |
| D355,121 | S | | 2/1995 | Kohl |
| 5,386,918 | A | | 2/1995 | Neveras et al. |
| 5,397,013 | A | | 3/1995 | Adams et al. |
| 5,423,442 | A | | 6/1995 | Nozawa et al. |
| 5,435,456 | A | | 7/1995 | Dubach |
| 5,489,035 | A | | 2/1996 | Fuchs |
| 5,499,736 | A | | 3/1996 | Kohl |
| 5,501,348 | A | | 3/1996 | Takeuchi |
| 5,509,582 | A | | 4/1996 | Robbins, III |
| 5,531,349 | A | | 7/1996 | Wojcik et al. |
| 5,540,343 | A | | 7/1996 | Schumacher |
| 5,542,579 | A | | 8/1996 | Robbins, III |
| 5,558,239 | A | | 9/1996 | Dubach |
| 5,566,850 | A | | 10/1996 | Forsyth et al. |

| | | | | | |
|---|---|---|---|---|---|
| 5,579,957 | A | | 12/1996 | Gentile et al. | |
| 5,588,546 | A | | 12/1996 | Farside | |
| 5,603,421 | A | | 2/1997 | Opresco | |
| 5,620,107 | A | | 4/1997 | Takeuchi | |
| 5,632,417 | A | | 5/1997 | Robbins, III et al. | |
| 5,642,824 | A | | 7/1997 | Hess, III et al. | |
| 5,667,089 | A | | 9/1997 | Moore | |
| 5,667,094 | A | | 9/1997 | Rapchak et al. | |
| D385,791 | S | | 11/1997 | Forsyth et al. | |
| 5,755,352 | A | | 5/1998 | Wojcik et al. | |
| 5,758,793 | A | | 6/1998 | Forsyth et al. | |
| 5,762,216 | A | | 6/1998 | Takeuchi | |
| 5,785,193 | A | | 7/1998 | Kobayashi et al. | |
| 5,799,838 | A | | 9/1998 | Miller | |
| 5,823,345 | A | * | 10/1998 | Nask et al. | 206/509 |
| D404,201 | S | | 1/1999 | Wennerstrom | |
| 5,865,353 | A | | 2/1999 | Baudin | |
| 5,875,907 | A | | 3/1999 | Lay | |
| 5,908,125 | A | | 6/1999 | Opresco | |
| 5,913,435 | A | | 6/1999 | Fuchs | |
| D413,064 | S | | 8/1999 | Bansal | |
| D414,698 | S | | 10/1999 | Mogard et al. | |
| 5,971,231 | A | | 10/1999 | Samz et al. | |
| 5,975,368 | A | * | 11/1999 | Wood | 222/151 |
| 5,996,859 | A | | 12/1999 | Beck | |
| 6,039,224 | A | * | 3/2000 | Dallas et al. | 222/565 |
| 6,041,477 | A | | 3/2000 | Rentsch et al. | |
| 6,102,257 | A | | 8/2000 | Goyet | |
| 6,116,469 | A | * | 9/2000 | Wallays et al. | 222/148 |
| 6,152,320 | A | | 11/2000 | Hierzer et al. | |
| 6,158,632 | A | | 12/2000 | Ekkert | |
| 6,164,503 | A | | 12/2000 | Forsyth et al. | |
| D436,040 | S | | 1/2001 | Warner et al. | |
| 6,250,507 | B1 | | 6/2001 | Ekkert | |
| 6,250,517 | B1 | | 6/2001 | Samz et al. | |
| 6,283,317 | B1 | | 9/2001 | Benoit-gonin et al. | |
| 6,289,906 | B1 | | 9/2001 | Vanden Dries et al. | |
| 6,299,033 | B1 | | 10/2001 | VerWeyst et al. | |
| 6,308,870 | B1 | | 10/2001 | Samz et al. | |
| 6,321,923 | B1 | | 11/2001 | Wood | |
| 6,332,551 | B1 | | 12/2001 | Copeland | |
| D453,892 | S | | 2/2002 | Lindsay et al. | |
| RE37,634 | E | | 4/2002 | Hickman et al. | |
| 6,382,476 | B1 | | 5/2002 | Randall et al. | |
| 6,405,885 | B1 | | 6/2002 | Elliott | |
| 6,439,410 | B1 | | 8/2002 | Dubach | |
| 6,460,712 | B1 | | 10/2002 | Smith et al. | |
| 6,460,718 | B1 | | 10/2002 | Vogel | |
| 6,460,726 | B1 | | 10/2002 | Hierzer et al. | |
| 6,464,113 | B1 | | 10/2002 | Vogel | |
| 6,488,187 | B1 | | 12/2002 | Sheffler et al. | |
| D468,639 | S | | 1/2003 | Wennerstrom et al. | |
| 6,510,971 | B1 | | 1/2003 | Martin | |
| D472,138 | S | | 3/2003 | Brozell et al. | |
| 6,550,626 | B1 | | 4/2003 | Randall | |
| 6,575,323 | B1 | | 6/2003 | Martin et al. | |
| D476,892 | S | | 7/2003 | Martin et al. | |
| D476,897 | S | | 7/2003 | Brozell | |
| 6,631,820 | B1 | | 10/2003 | Harrold et al. | |
| 6,644,487 | B1 | | 11/2003 | Smith et al. | |
| 6,688,501 | B1 | | 2/2004 | DeGroot et al. | |
| 6,691,901 | B1 | | 2/2004 | Parve et al. | |
| 6,761,279 | B1 | | 7/2004 | Martin et al. | |
| 6,766,926 | B1 | | 7/2004 | Elchert | |
| 6,786,363 | B1 | | 9/2004 | Lohrman | |
| 6,830,721 | B1 | | 12/2004 | Martin | |
| 6,880,736 | B1 | | 4/2005 | Gnepper | |
| 6,935,543 | B1 | | 8/2005 | DeGroot et al. | |
| D509,426 | S | | 9/2005 | Samz et al. | |
| 6,948,643 | B1 | | 9/2005 | Lohrman | |
| 2003/0116879 | A1 | | 6/2003 | Mueller et al. | |
| 2004/0134942 | A1 | | 7/2004 | Parve et al. | |
| 2004/0169307 | A1 | | 9/2004 | Mueller et al. | |
| 2004/0226950 | A1 | | 11/2004 | Samz et al. | |
| 2005/0023304 | A1 | | 2/2005 | Vogel et al. | |

FOREIGN PATENT DOCUMENTS

| | | |
|---|---|---|
| CH | 491014 | 7/1970 |
| DE | 3734156 | 4/1988 |
| DE | 4239299 | 3/1994 |
| EP | 0590325 | 4/1988 |
| EP | 0631942 | 1/1995 |
| WO | WO 94/20713 | 9/1994 |

OTHER PUBLICATIONS

Cap of a type understood to be commercially available from Weatherchem Corporation (seven photographs; one sheet). Admitted Prior Art.

Cap of a type understood to be commercially available from Kraft Foods North America, Inc. (six photographs; one sheet).

Cap of a type understood to be commercially available and having two flaps with two dispensing openings (six photographs, one sheet). Admitted Prior Art.

Cap of a type understood to be commercially available from Kraft Foods North America, Inc. (ten photographs, one sheet). Admitted Prior Art.

Cap of a type understood to be commercially available from Nestle Purina Petcare Company (twelve photographs, two sheets). Date Unknown.

Cap of a type understood to be commercially available from Resibel N.V. in or about 1996 and made available/obtained during discovery in *Gateway Plastics, Inc.* v. *Weatherchem Corp.*, Case No. 02-C-0870 (E.D. Wis.) (twelve photographs, two sheets). Admitted Prior Art.

Cap of a type understood to be commercially available from C.A.P.S. Inc. (eight photographs, two sheets). Date Unknown.

* cited by examiner

FIGURE 2A
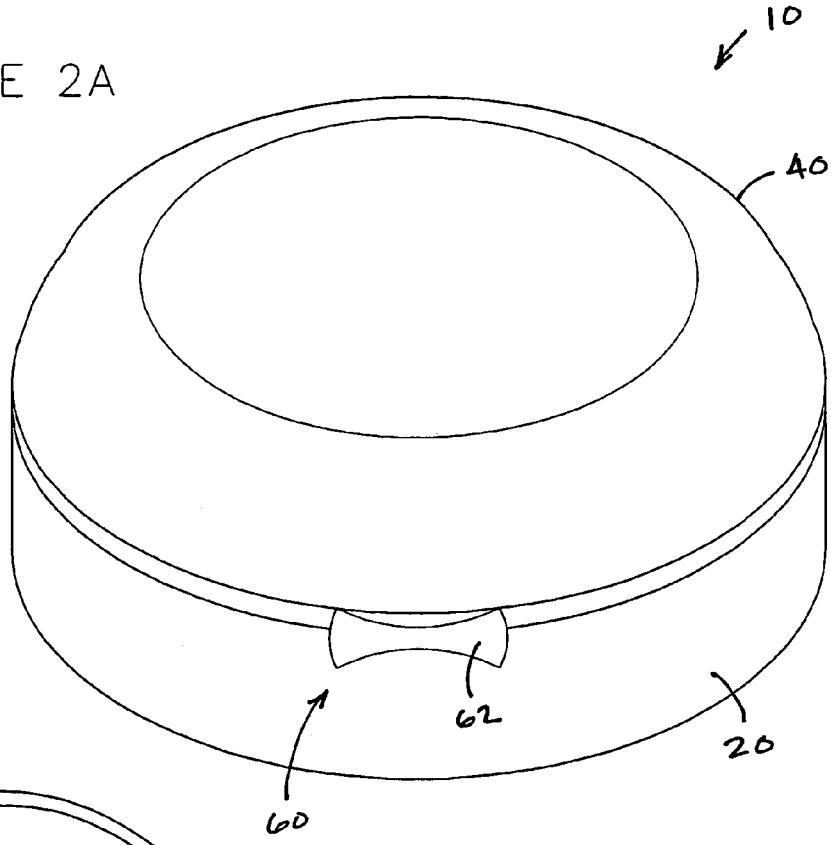
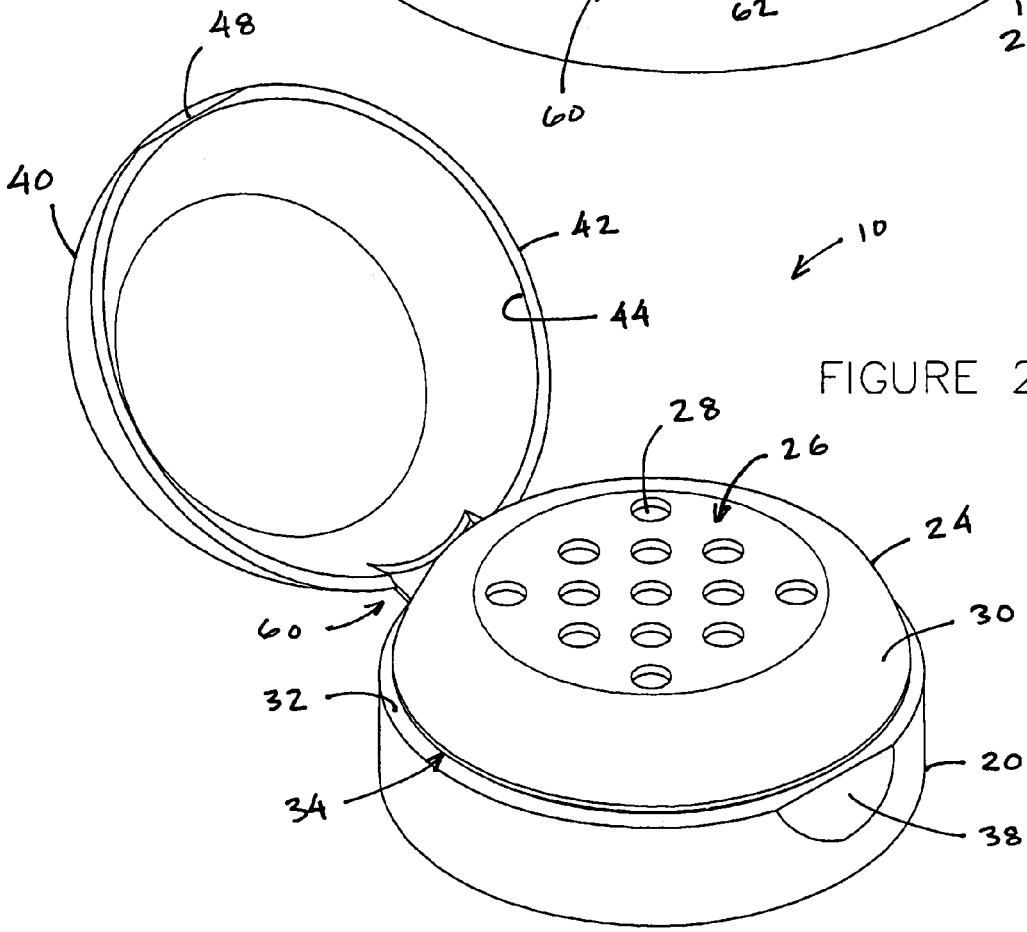
FIGURE 2B

FIGURE 2C
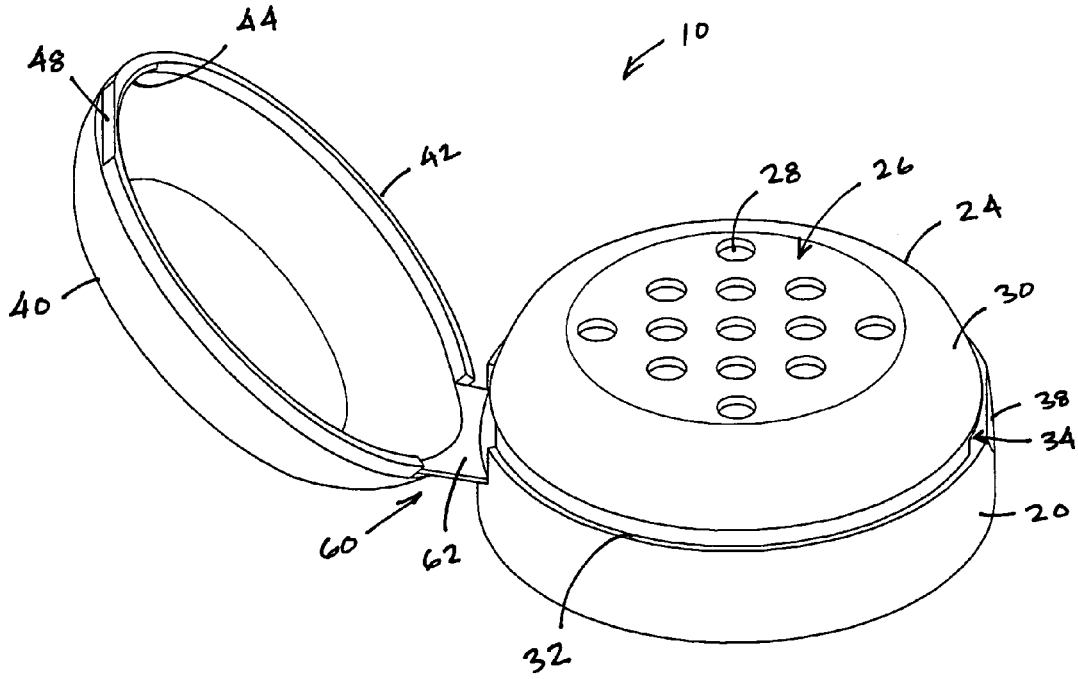
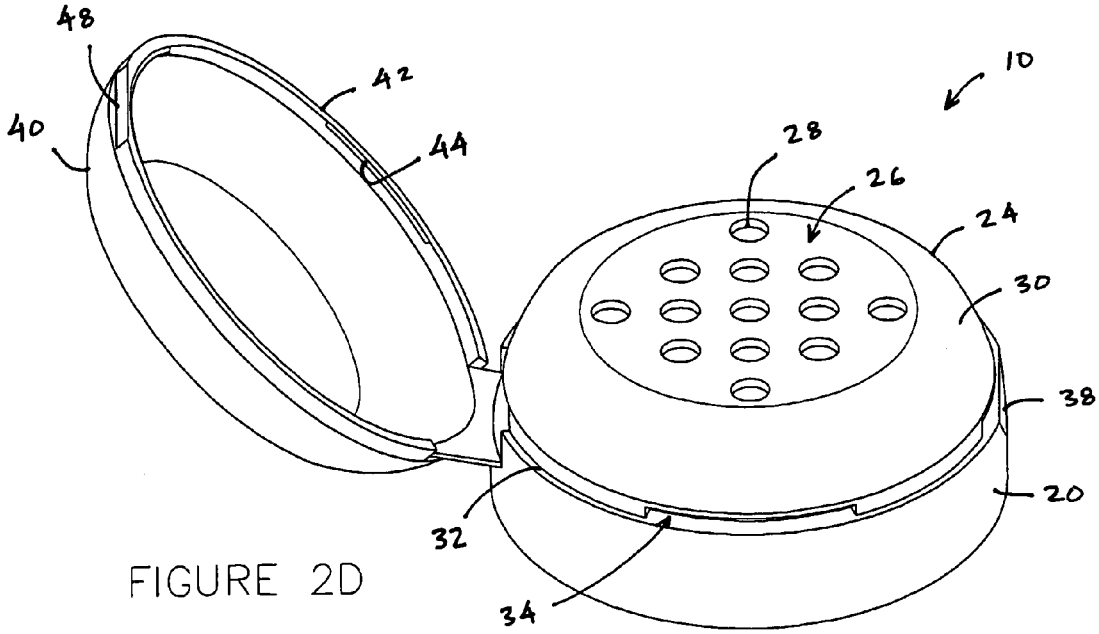
FIGURE 2D

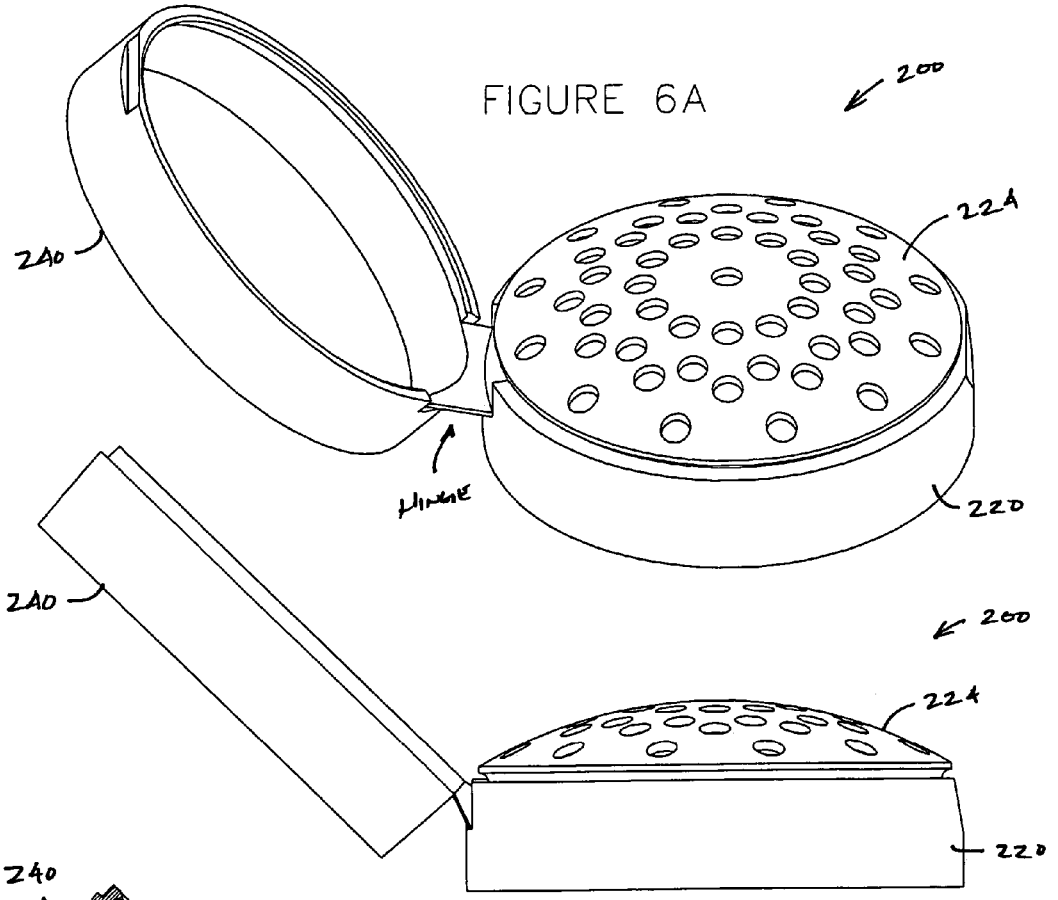
FIGURE 6A
FIGURE 6B
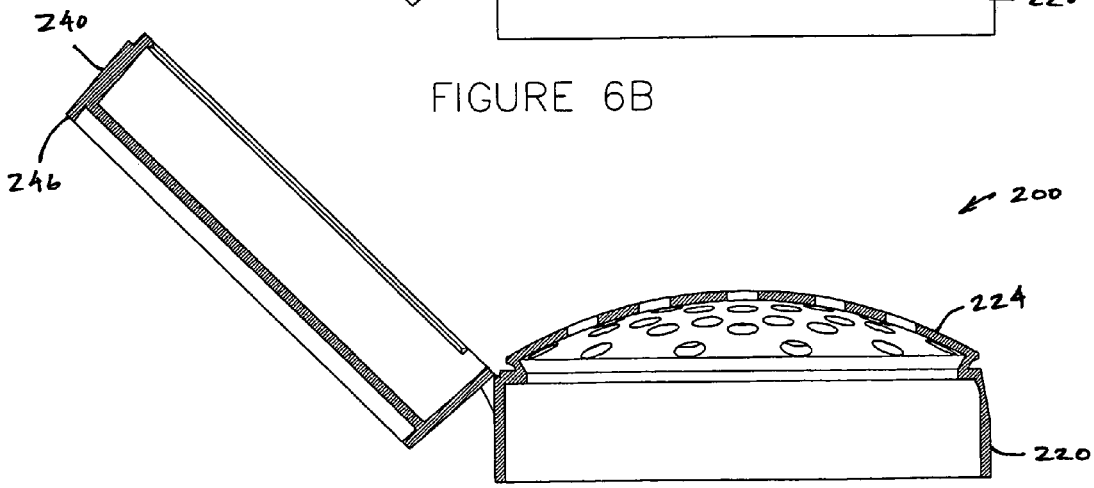
FIGURE 6C

FIGURE 13A
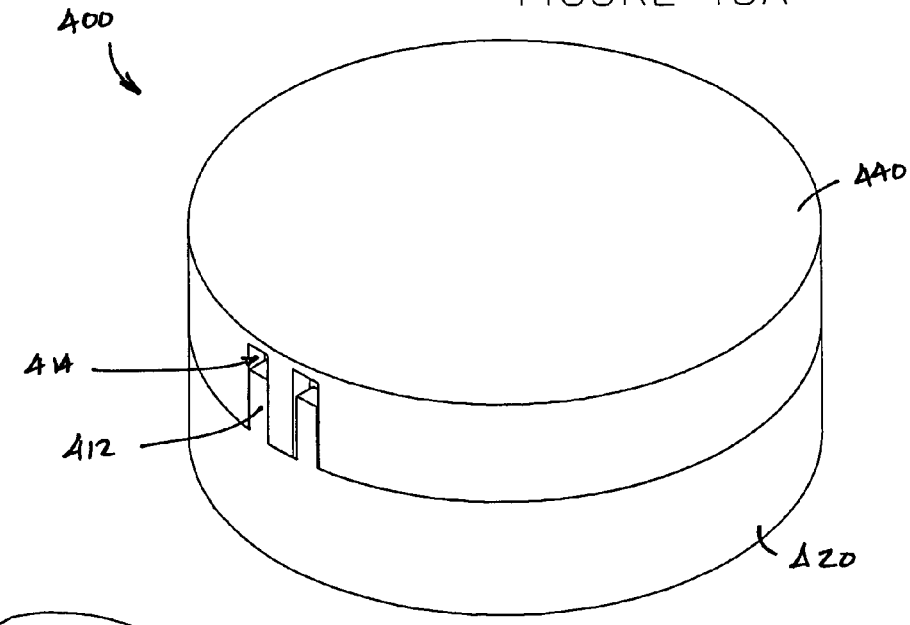
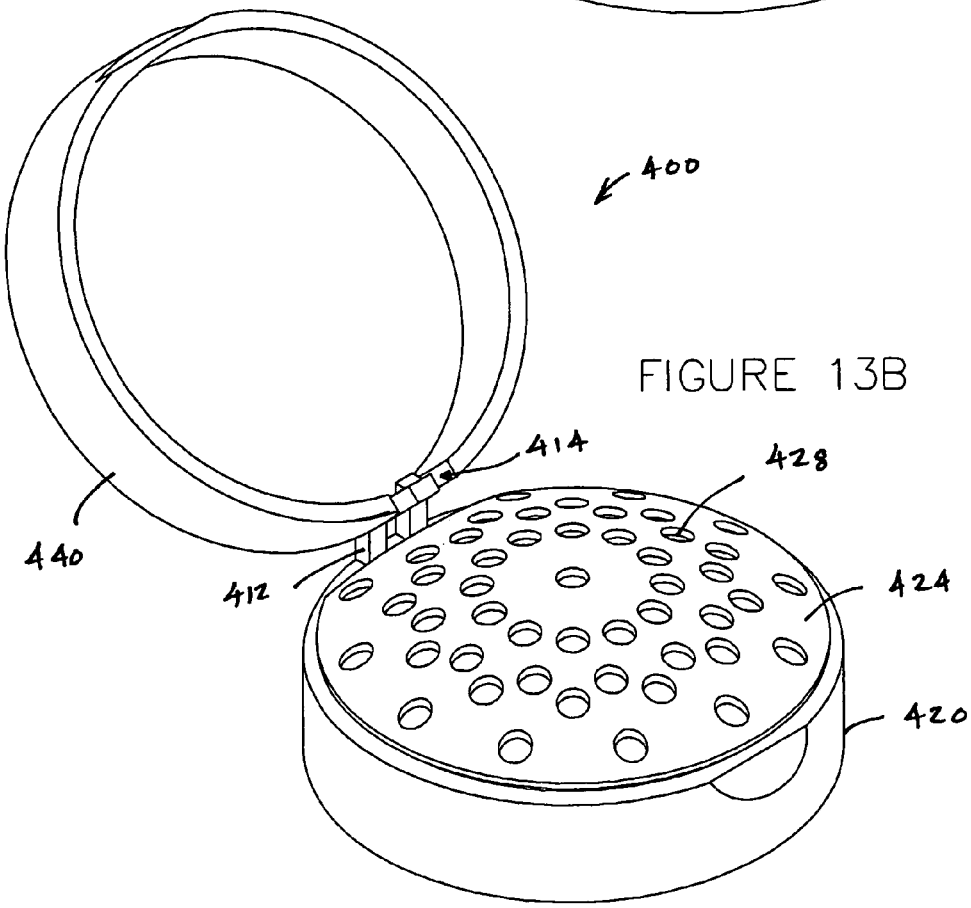
FIGURE 13B

FIGURE 13C
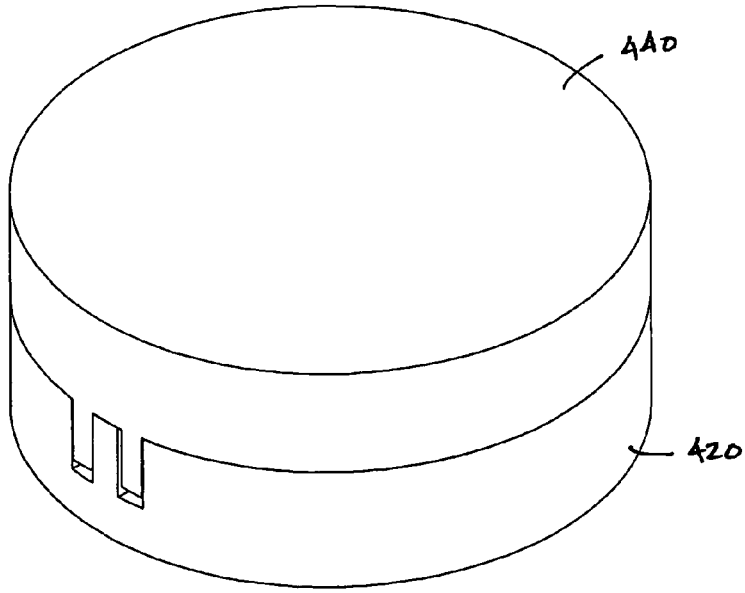
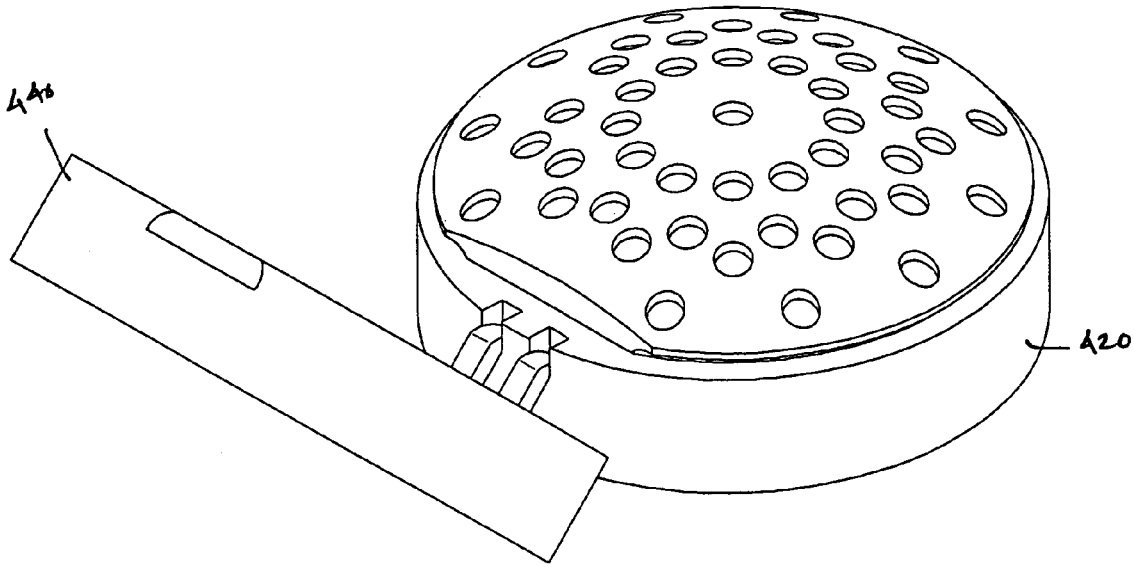
FIGURE 13D

CLOSURE FOR A CONTAINER

CROSS REFERENCE TO RELATED APPLICATIONS

The present Application claims the benefit of priority, as available under 35 U.S.C. § 119(e)(1), to U.S. Provisional Patent Application No. 60/435,482 titled "Improved Closure for a Container" filed on Dec. 21, 2002 (which is incorporated by reference in its entirety).

FIELD

The present inventions relate to an improved closure (e.g. cap or cover) for a container. The present inventions relate more particularly to an improved closure for dispensing matter from a container.

BACKGROUND

It is well known to provide a closure having one or more apertures for dispensing matter (e.g. particulate food stuffs or the like, such as cheese, spices, etc.) that is provided within a container. Such known closures typically have a base coupled to an opening on the container and a top having one or more dispensing apertures for dispensing the matter. Such known closures may have a removable cover or elements such as flaps that are movable between an open position in which the matter may readily be dispensed from the container (through dispensing apertures) and a closed position where the dispensing apertures are covered (so that the matter cannot readily be dispensed).

Such known closures may be of a type having a top with "doors" or "flaps," each covering a corresponding portion of the closure, for example, one portion having a single opening for "spooning" matter from the container and one portion having a series of smaller dispensing apertures for "shaking" matter from the container. It is known to form such closures in either of two different configurations: either as two separately formed pieces (e.g. a base with a separate top that can be assembled together) (see, e.g. U.S. Pat. No. 5,219,100 titled "Flap Closure Lockable in an Open Position" issued on Jun. 15, 1993) or as an integrally formed (single) piece (see, e.g. U.S. Pat. No. 6,250,517 titled "Integrally-Formed Container" issued on Jun. 26, 2001), from a moldable material such as plastic (e.g. in an injection molding operation).

It is generally known that the formation of an injection-molded two-piece cap or closure will allow for a die or mold that is easier to build, use and maintain, and that can be operated at a higher production rate (or throughput), in comparison with an integrally formed (one-piece) cap. Moreover, it is also generally known to be much easier to provide certain "molded-in" features in a two-piece cap, because there is less potential that such features will cause "interference" (e.g. undercuts, etc.) in separation of the mold, or other problems such as seams, differential cooling rates, warping, distortion, etc. due to the location of material injection, during the design of the mold or in the molding operation. In the separately formed pieces of a two-piece cap, features formed on one piece of the cap are generally independent of features formed on the other piece and tend to result in molds or dies that are less complex and less expensive than molds and dies for a one-piece cap. (Each piece can be formed in a separate mold, and designed independently of the other mold.)

Such two-piece closures typically have a separate top that is attached to a base to form the closure for the container. A disadvantage of such known two-piece closures is that one or more additional assembly and/or mating and alignment steps may be required to complete manufacture. Another disadvantage is that the separate pieces may become separated accidentally or inadvertently, during assembly, shipping, merchandising, storage, use or other activity which can cause damage and/or inconvenience to end users.

For example, referring to FIGS. 1A through 1C, a prior art closure for a container is shown having a two-piece construction with a base (with dispensing apertures) and a separate removable cover. The cover is coupled to the base when the closure is in a closed position (and may be secured to the base by an additional fastening operation such as sonic welding at the time of initial assembly or attachment to the container). Use of the closure in a dispensing position requires removal of the cover from the base. As a result the cover may become lost or misplaced, or become accidentally or inadvertently separated from the base, during assembly, use, transport, etc. and the container may become potentially unfit for further use or sale. The closure provides a base having a plurality of apertures (generally but not completely arranged in the manner of a conventional "shaker", e.g. of glass or steel construction). The cover is made of a transparent (molded) plastic; the base is made of a colored (opaque molded) plastic. (The container is made of a plastic such as polyethylene [PET].)

It would be desirable to provide an improved closure for a container of a type disclosed in the present application that may include any one or more of these or other advantageous features:

1. An improved closure for a container that is integrally formed (and yet provides the desired "molded-in" features).
2. An improved closure for a container having a single cover that generally conforms (in shape) to the base when the closure is in the closed position.
3. An improved closure for a container having a single cover that is attached to the base and is movable between the open position and the closed position.
4. An improved closure for a container having a single cover that has a hinge that tends to hold or retain the cover in an open position (away from the dispensing apertures) when the cover is in an open position and that tends to hold or urge the cover toward the dispensing apertures as the cover is moved toward the closed position.
5. An improved closure for a container having a single pivotal cover that may be secured to the top by a retaining element (such as a hinge or strap formed in one or more segments).
6. An improved closure for a container providing dispensing openings in a pattern configured to dispense a generally small amount (volume or flow rate) of matter when the container is moved to a first dispensing position and configured to dispense a greater amount (volume or flow rate) of matter when the container is move to a second dispensing position.
7. An improved closure for a container intended to retain matter within the container in the event the container is placed or falls to the side (or on its top).
8. An improved closure for a container that is integrally formed yet configured so that molding "interferences" such as "drafts" and "undercuts" are not present.
9. An improved closure for a container intended to provide a base with the appearance of a conventional kitchen "shaker" while providing a more convenient arrangement of a cover and the base.

10. An improved closure for a container having a single cover configured for rotational movement about the top to selectively open and close a pattern of dispensing openings.
11. An improved closure for a container having a single cover configured for rotational movement about the top that includes a collector configured to move accumulated matter on the top into the dispensing openings when the cover is rotated about the top.
12. An improved closure for a container that alternatively can be formed from two pieces, but wherein the two pieces can be linked in a suitable manner.

SUMMARY

The subject matter of the present application relates to an integrally-formed closure for a container comprising a body and a cover. The body comprises a generally cylindrical base configured to be coupled to the receptacle, a top portion coupled to the base and including a dispensing aperture, a recess extending around at least a portion of the periphery of the top portion, and a first element located in the recess. The cover is coupled to the body for movement between a closed position in which the dispensing aperture is closed and an open position in which the dispensing aperture is open. The cover comprises a bottom surface, a skirt extending from the bottom surface and configured to be received within the recess in the top portion when the cover is in the closed position, a second element located on the skirt, a projection extending from the bottom surface of the cover and configured to extend into the dispensing aperture of the top portion when the cover is in the closed position, and an annular projection extending from a top surface of the cover. The first element and the second element are configured to cooperate with one another to releasably retain the cover in the closed position.

The subject matter of the present application also relates to an integrally-formed closure for a container comprising a body, a cover, and a hinge. The body comprises a generally cylindrical base including a thread configured to engage a threaded neck of a receptacle, a top portion coupled to the base and having a first contour and including a dispensing aperture, a recess extending around at least a portion of the periphery of the top portion, a first element located in the recess, and an indentation near the recess. The cover comprises a bottom surface having a second contour, a downwardly extending skirt configured to be received within the recess in the top portion when the cover is in the closed position, a second element located on the skirt, a projection extending from the bottom surface of the cover and conflaured to extend into the dispensing aperture of the top portion when the cover is in the closed position, and an annular projection extending from a top surface of the cover. The hinge is coupled to the periphery of the body and the periphery of the cover and is configured so that the cover is pivotable about an axis generally tangent to the base between a closed position in which the dispensing aperture is closed and an open position in which matter may be dispensed through the dispensing aperture. The first element and the second element are configured to cooperate with one another to releasably retain the cover in the closed position. The cover extends radially outward over the indentation in the body to provide a surface for facilitating the movement of the cover from the closed position to the open position.

The subject matter of the present application also relates to a closure for a container comprising a body and a cover. The body comprises a base configured to be coupled to a receptacle, a top portion coupled to the base and having a first contour, at least a portion of the first contour being non-planar, a dispensing aperture in the top portion, and a recess extending around at least a portion of the periphery of the top portion. The cover is coupled to the body for movement between a closed position in which the dispensing aperture is closed and an open position in which the dispensing aperture is open. The cover comprises a bottom surface having a second contour, and a skirt configured to be received within the recess in the top portion when the cover is in the closed position.

BRIEF DESCRIPTION OF THE DRAWINGS

FIGS. 2A through 2F are schematic views of an improved closure for a container according to a preferred embodiment.

FIGS. 6A through 6F are schematic views of an improved closure for a container according to another preferred embodiment.

FIGS. 13A through 13D are schematic views of an improved closure for a container according to another preferred embodiment.

DESCRIPTION OF EXEMPLARY EMBODIMENTS

Figure 1A:
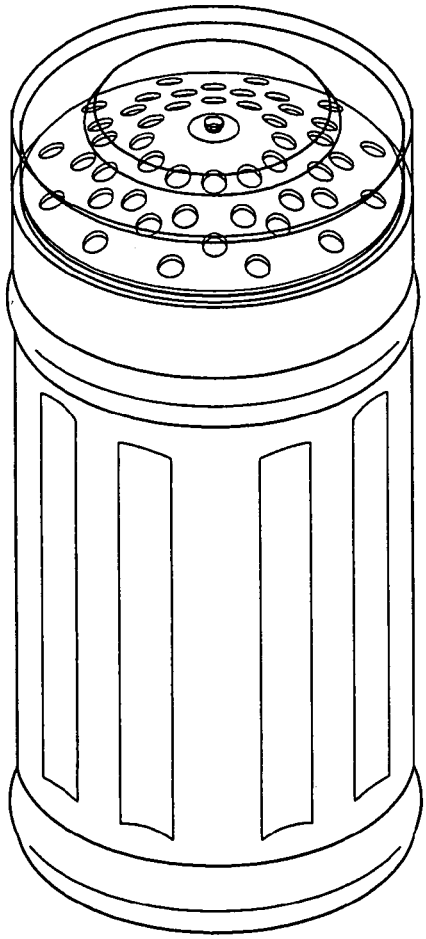
FIGURE 1A PRIOR ART
FIGS. 1A through 1C are perspective views of a prior art embodiment of a closure for a container.
Figure 1C:
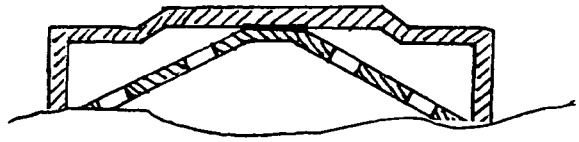
FIGURE 1C PRIOR ART
Figure 1B:
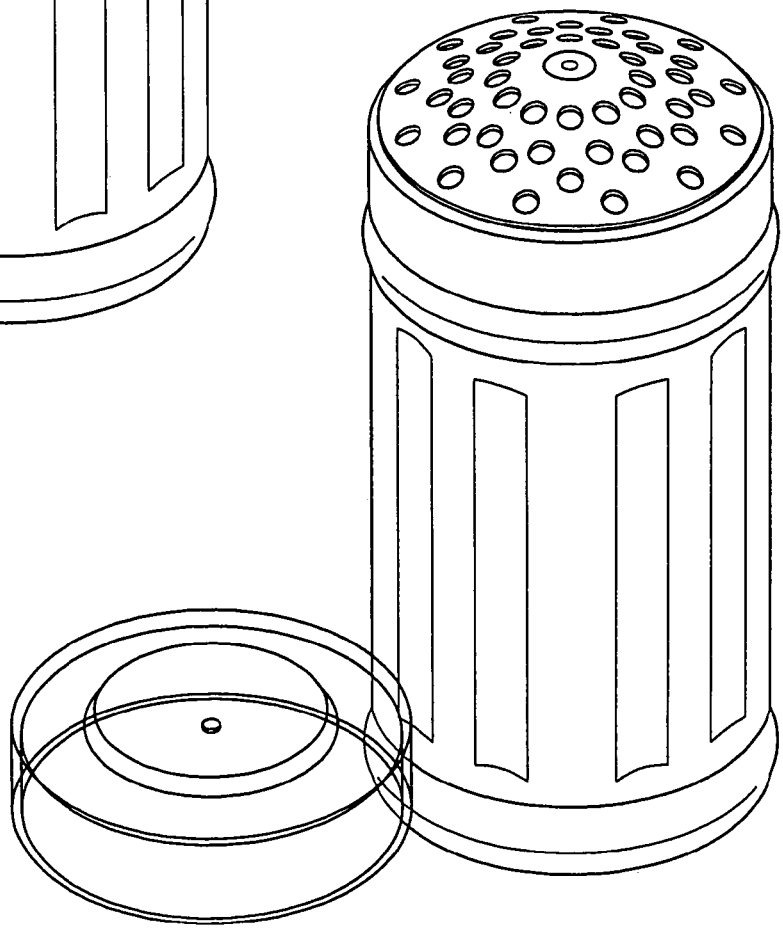
FIGURE 1B PRIOR ART
Figure 2E:
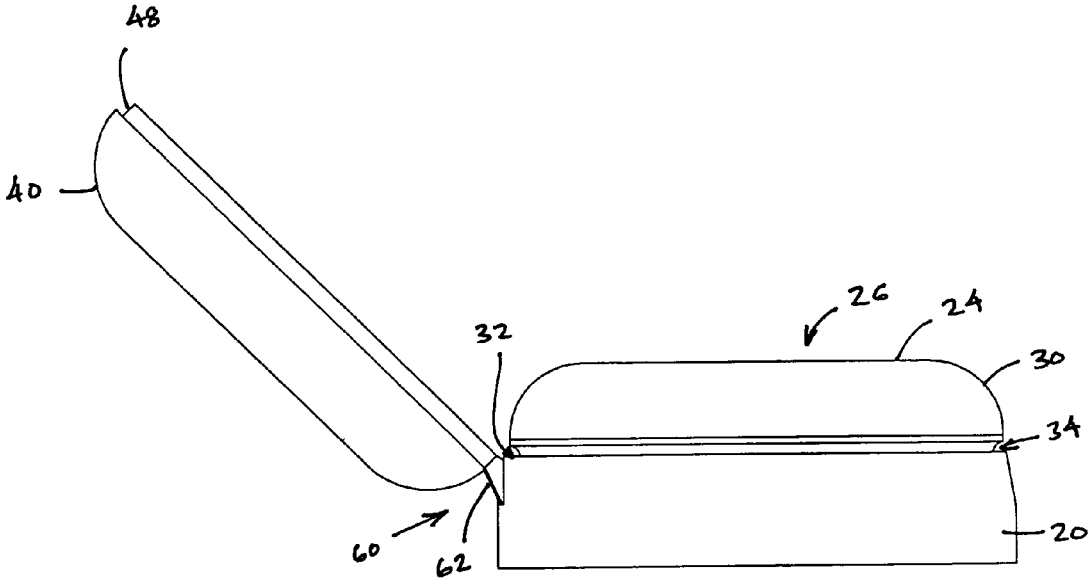
Figure 2F:
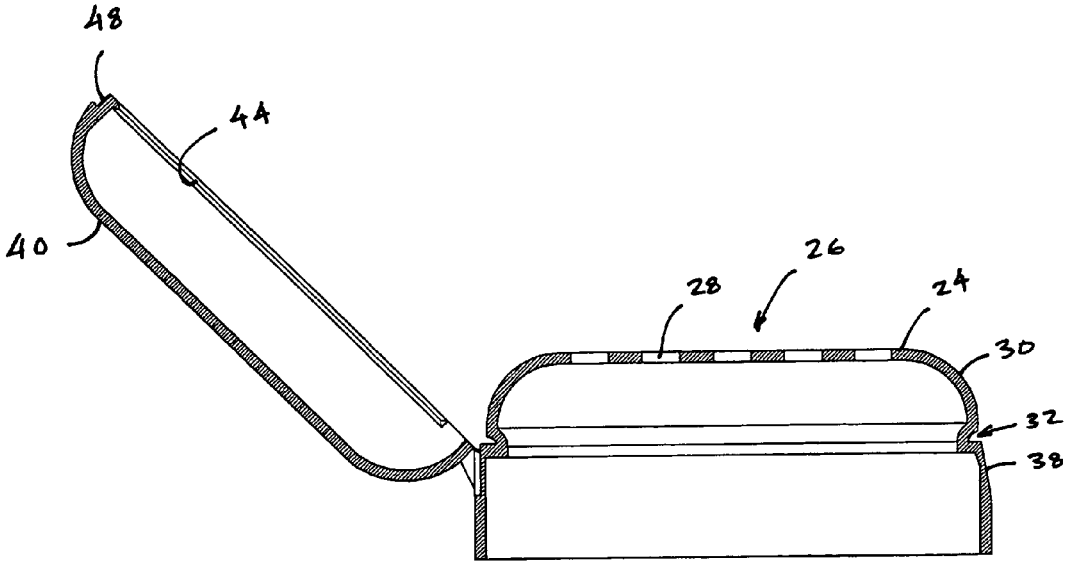

According to any preferred embodiment, the closure is of a type used for dispensing matter that is provided in a container. Such matter may include particulate food stuffs such as cheese, spices, etc. or a variety of other matter that is capable of being stored within the container and that can be dispensed through the various openings that may be provided in the closure.

Referring to FIGS. 2A through 2F, a closure for a container is shown according to a preferred embodiment. Closure 10 includes a base 20 (e.g. body, etc.), a top 24 (e.g. platform, etc.) that provides a dispensing surface 26 having a pattern of dispensing apertures 28 (e.g. openings, holes, etc.), and a cover 40 (e.g. lid, etc.).

Base 20 is shown schematically as a generally cylindrical member providing a generally smooth and uniform external surface configured for use with equipment for installing the closure onto a generally cylindrical top of a container. Base 20 may include a coupling member for securing the closure to an opening on a container (e.g. of a conventional type such as threads, snap-fit projections or grooves, etc.). Top 24 is shown schematically as an end wall portion having a contour (e.g. shape, form, etc.) that encloses a top end of base 20 and defines a pattern of dispensing apertures 28 (shown schematically, for example, in FIGS. 2B through 2D as a geometric pattern of substantially uniform circular holes but which may be a variety of other shapes and sizes) for dispensing matter from the container when the container is moved to a dispensing position (e.g. tilted, inverted, angled, etc.). According to a particularly preferred embodiment, top 24 is contoured to provide a rounded outer edge 30 (shown schematically as a substantially convex or "dome" shape with a central portion that is substantially planar) that forms a ledge 32 with base 20.

Figure 4A:
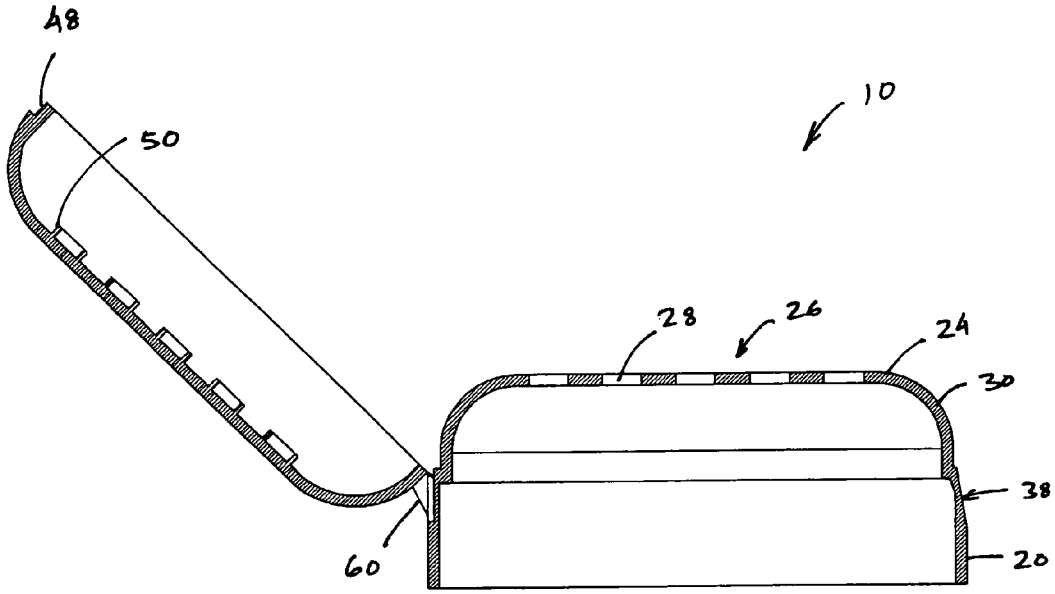
FIGS. 4A through 4H are schematic views of an improved closure for a container according to another preferred embodiment.
Figure 4B:
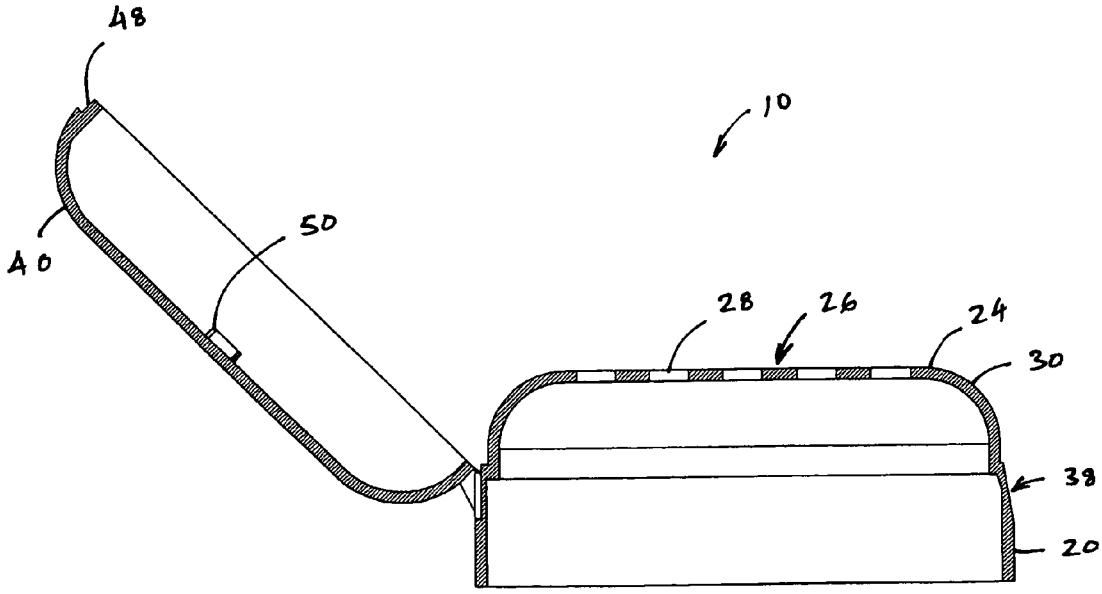
Figure 4C:
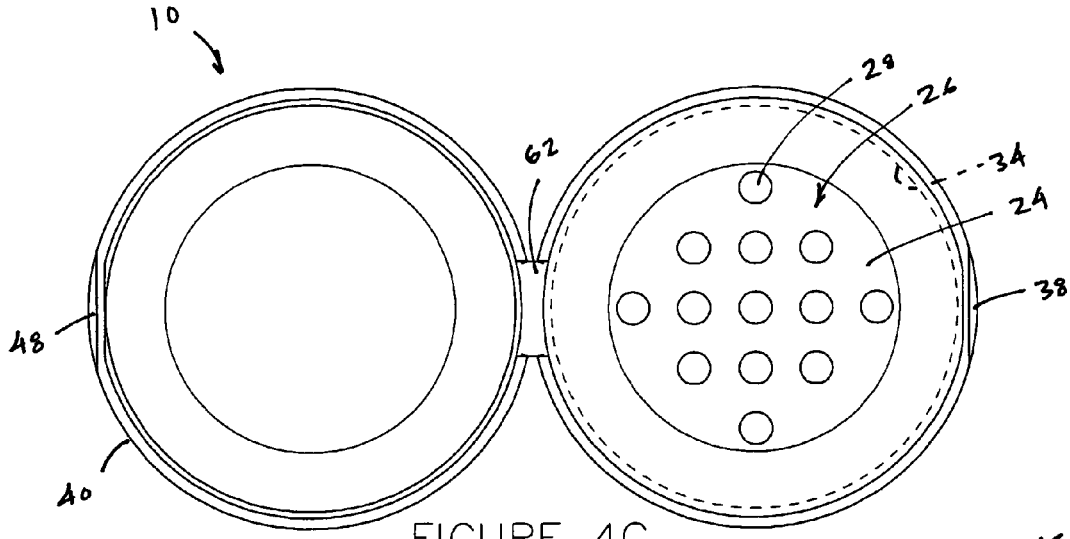
Figure 4D:
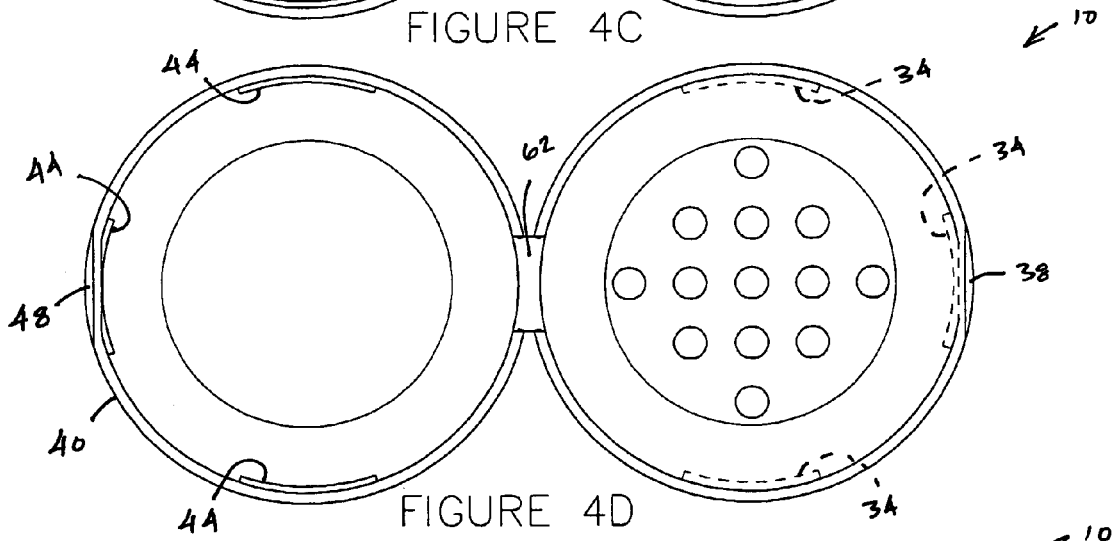
Figure 4E:
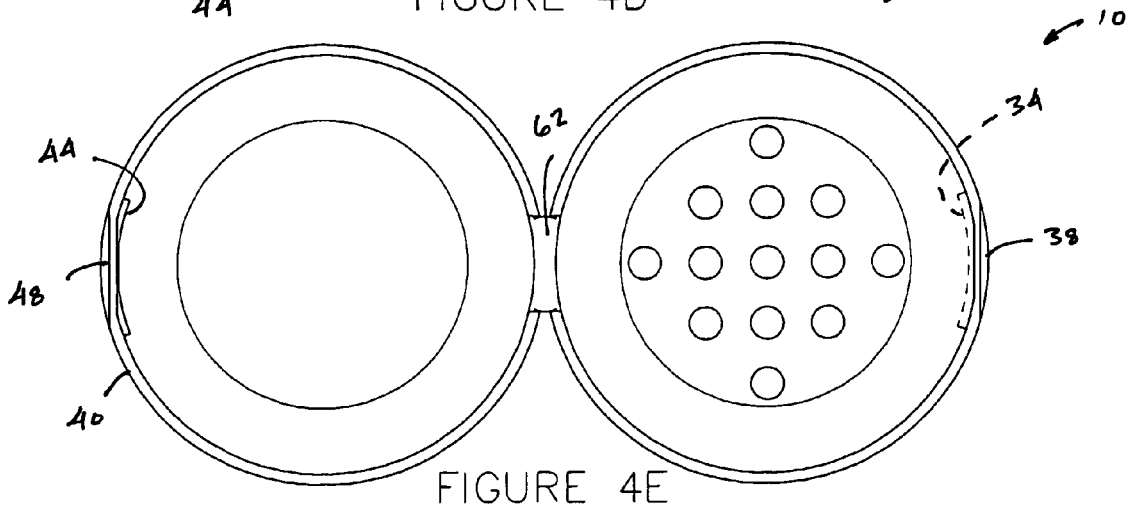
Figure 4F:
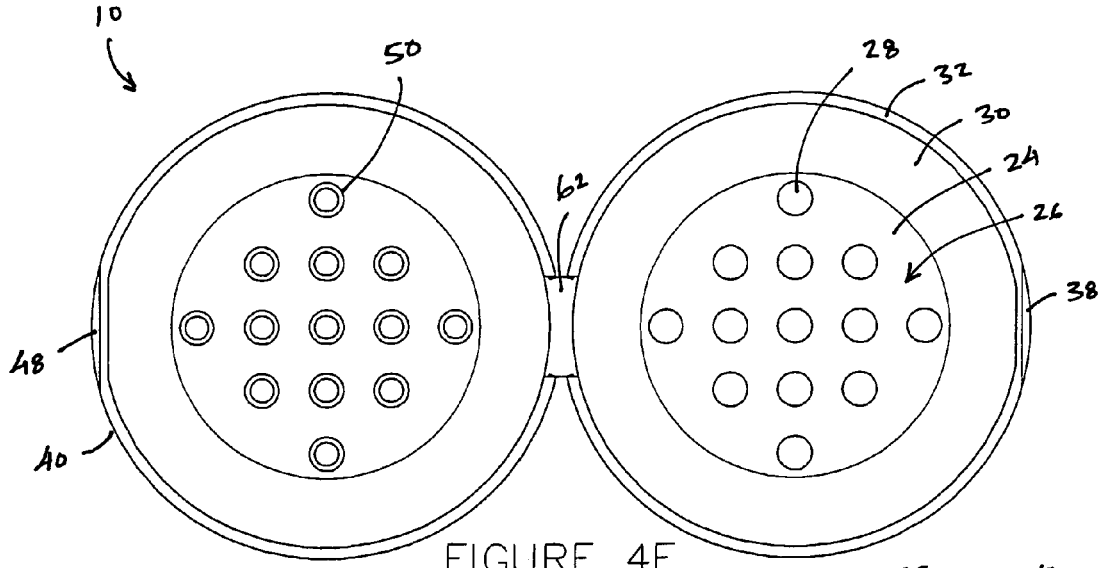
Figure 4G:
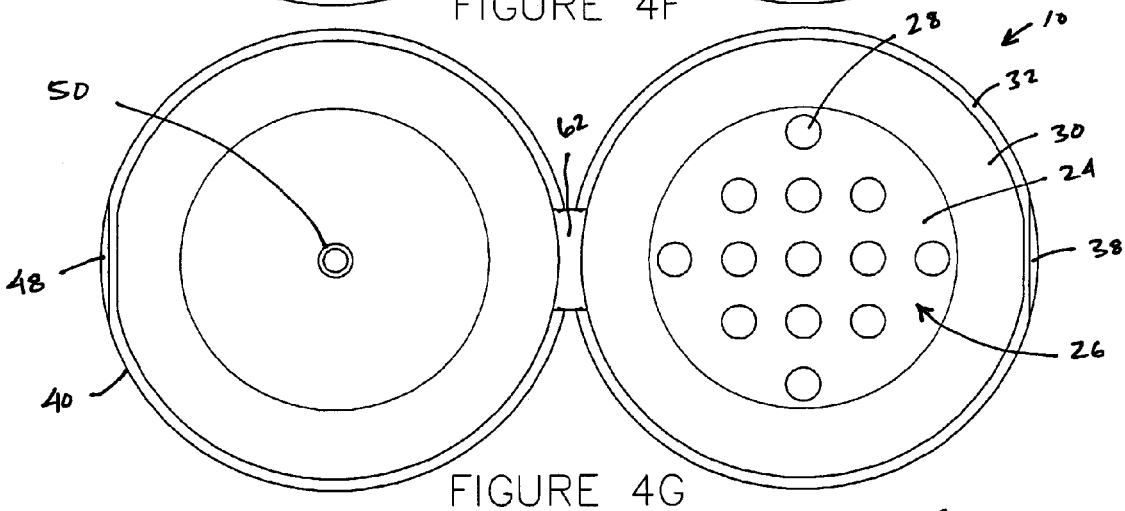
Figure 4H:
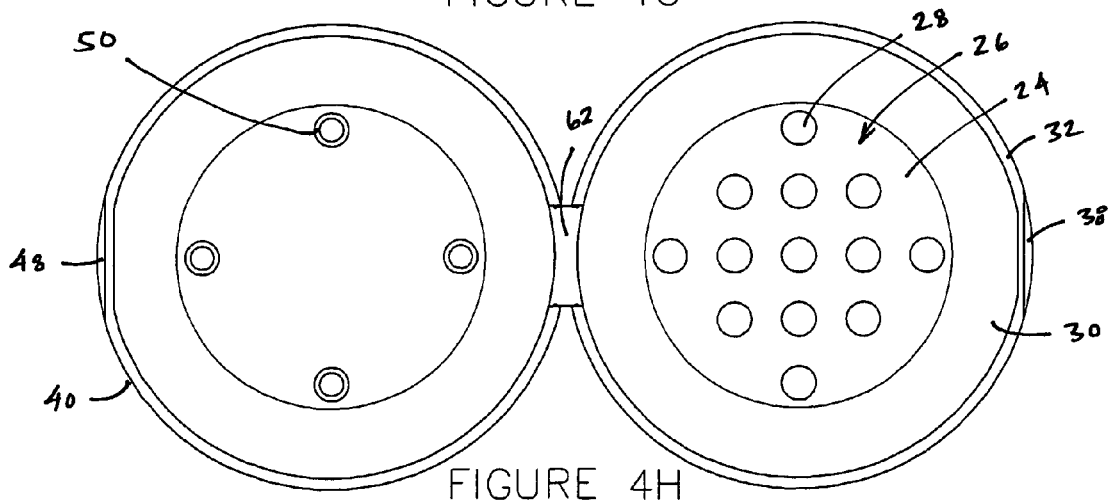
Figure 5A:
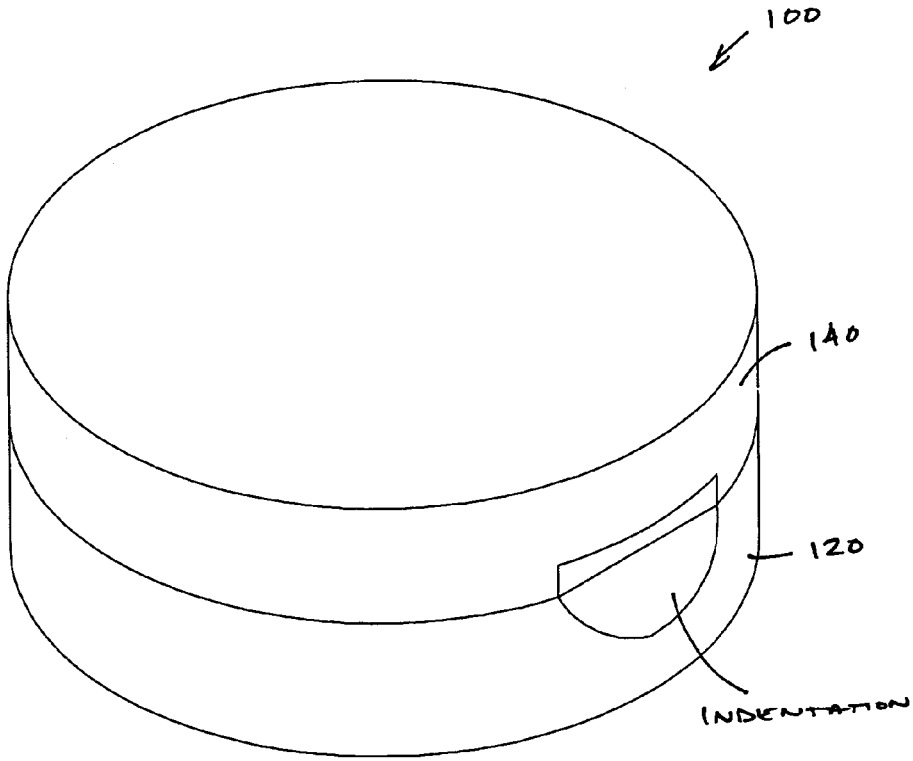
FIGS. 5A through 5H are schematic views of an improved closure for a container according to another preferred embodiment.
Figure 5B:
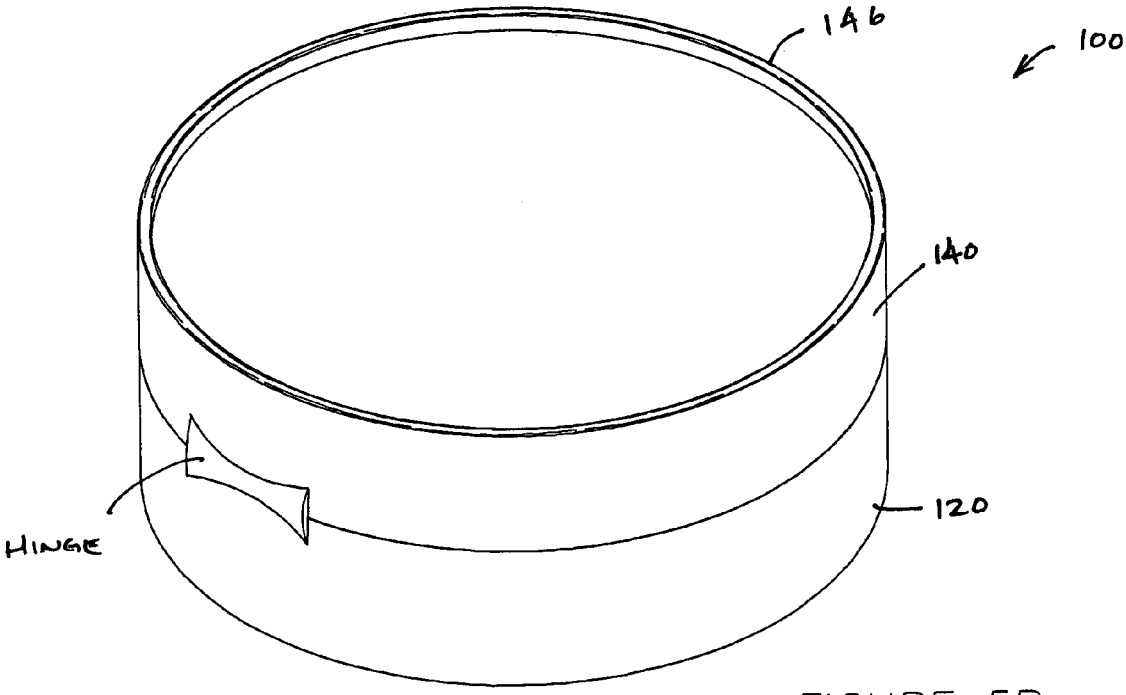
Figure 5C:
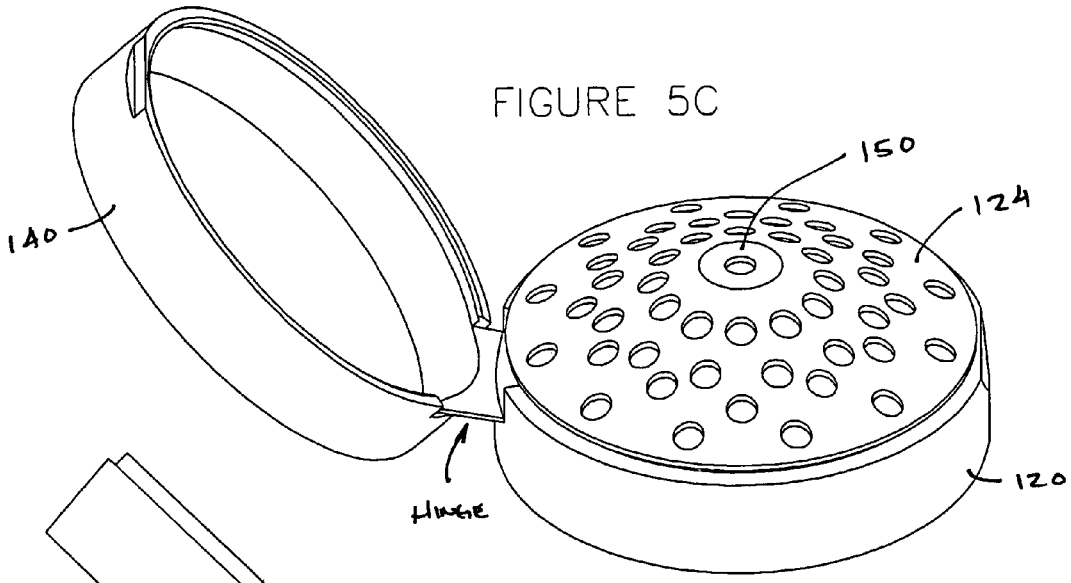
Figure 5D:
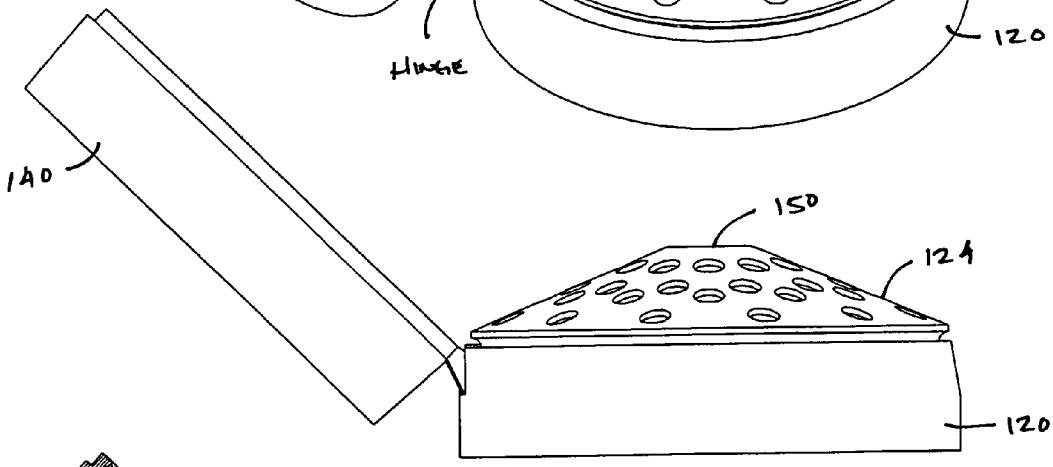
Figure 5E:
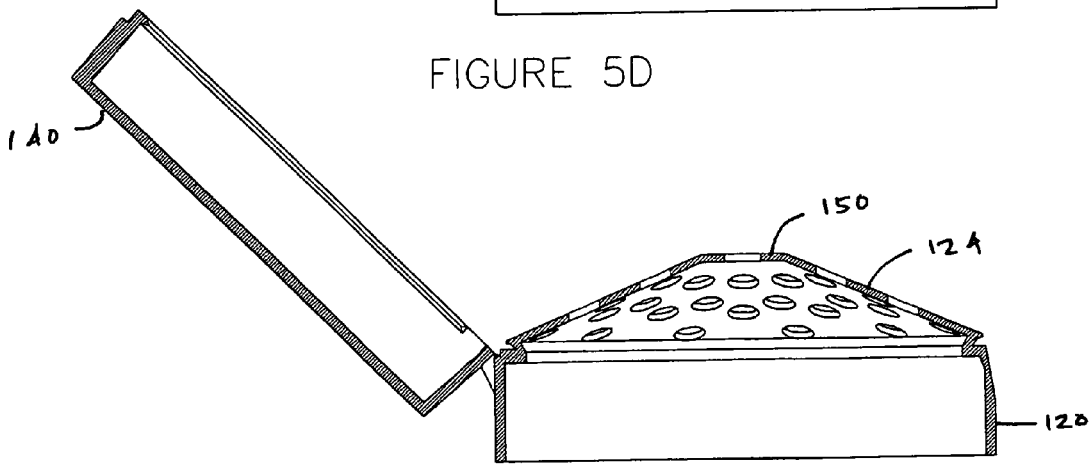
Figure 5F:
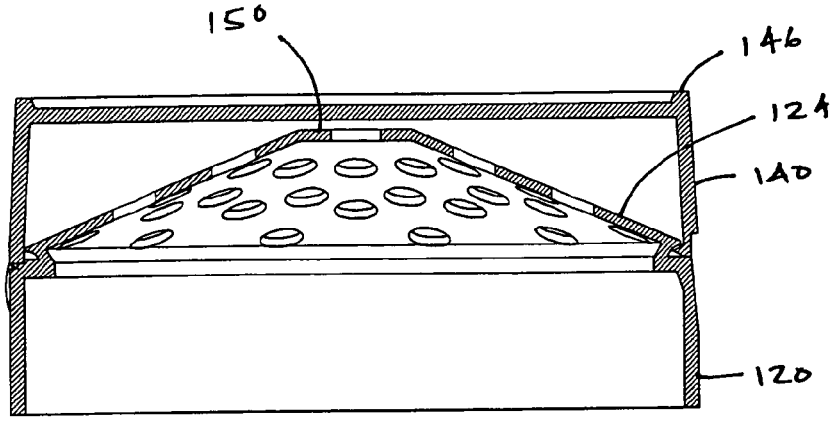
Figure 5G:
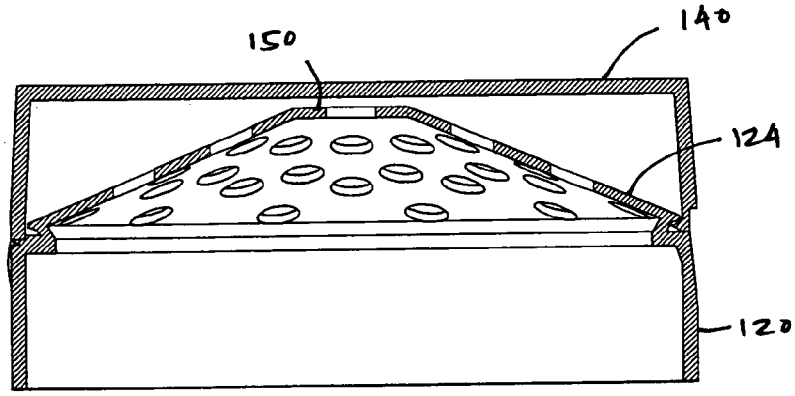
Figure 5H:
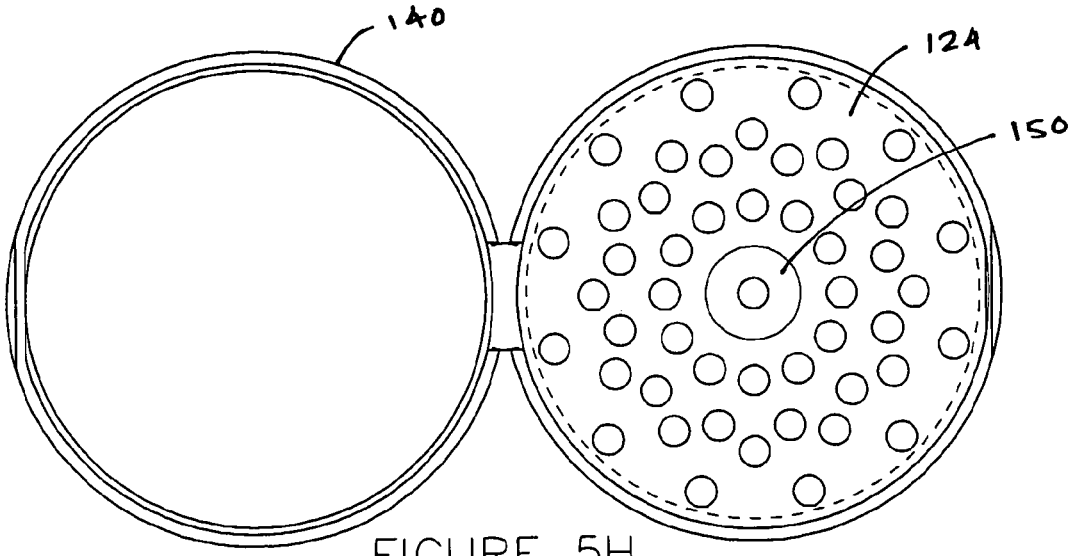
Figure 6D:
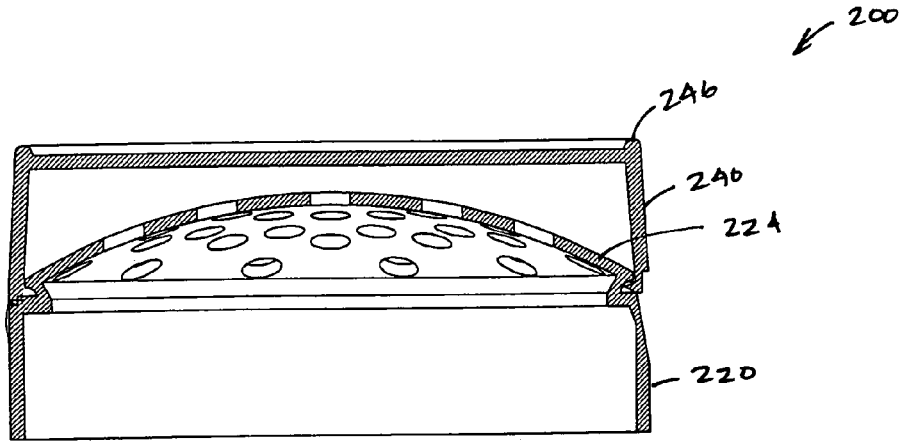
Figure 6E:
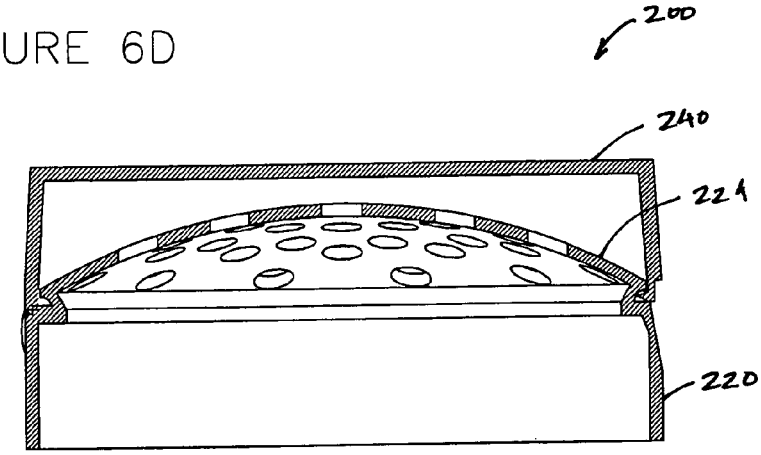
Figure 6F:
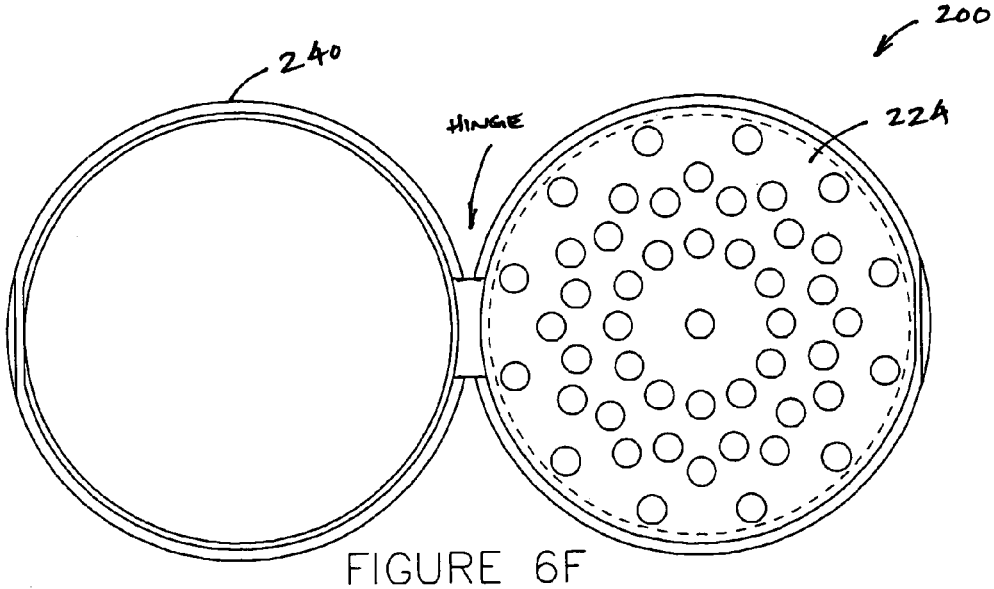
Figure 7A:
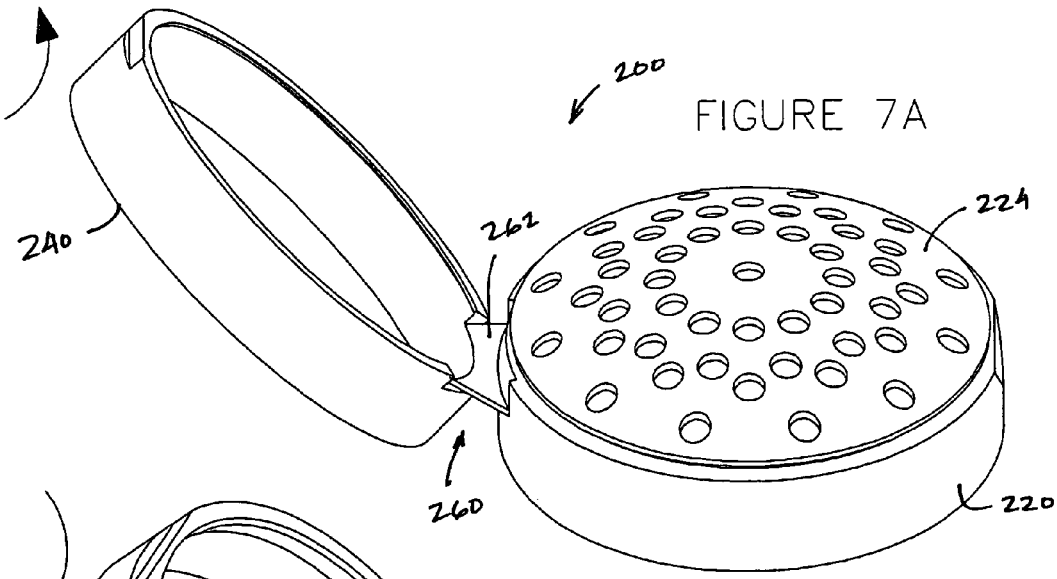
FIGS. 7A through 7E are schematic views of an improved closure for a container according to another preferred embodiment.
Figure 7B:
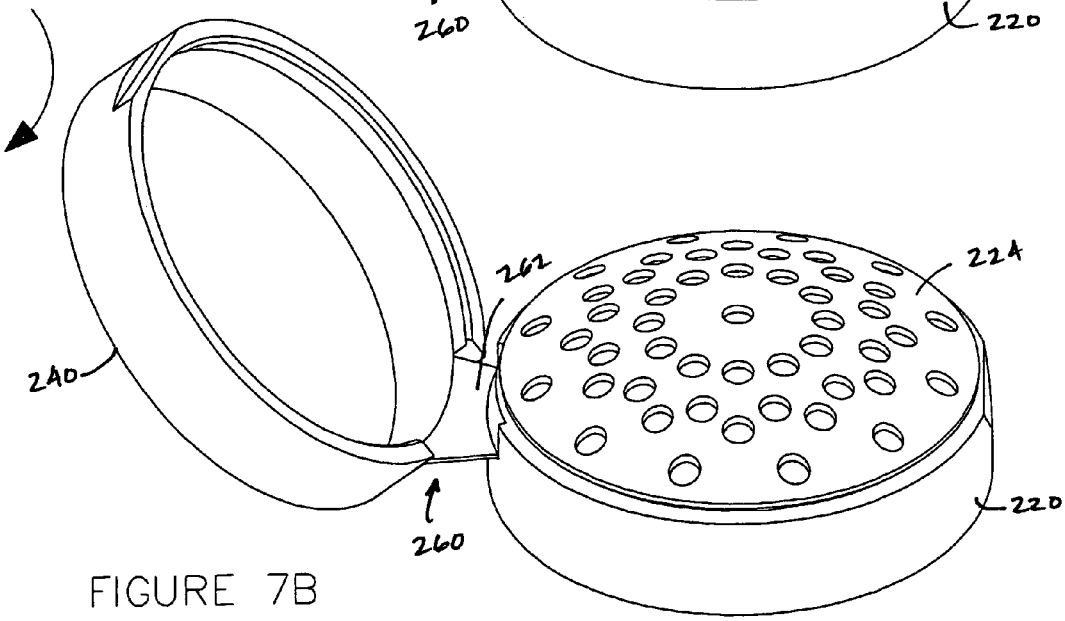
Figure 7C:
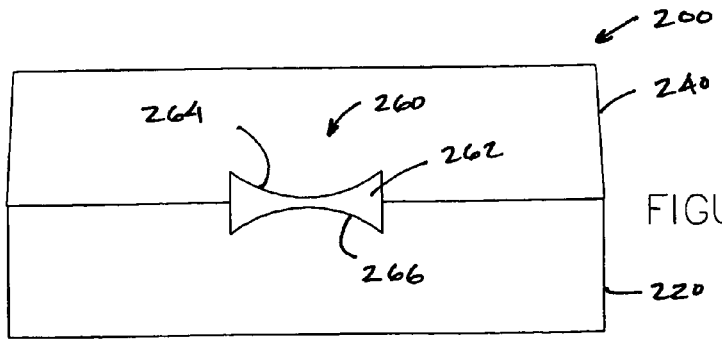
Figure 7D:
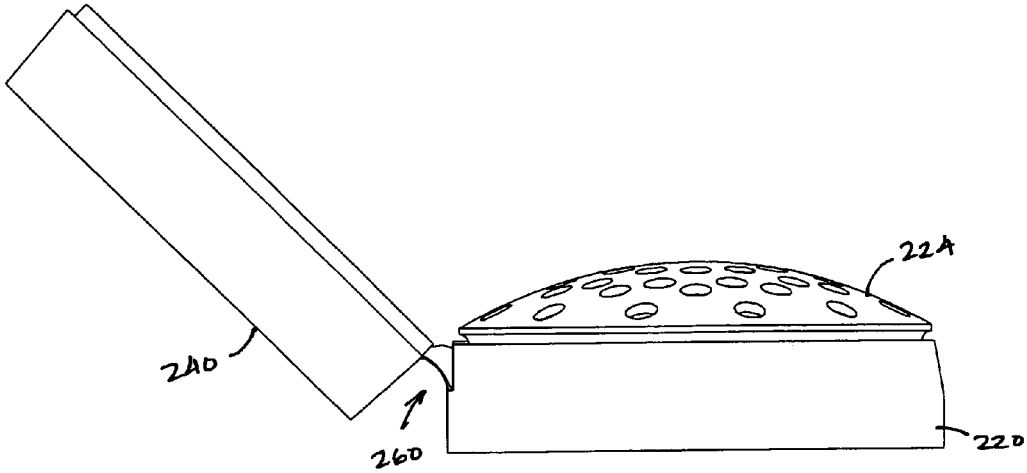
Figure 7E:
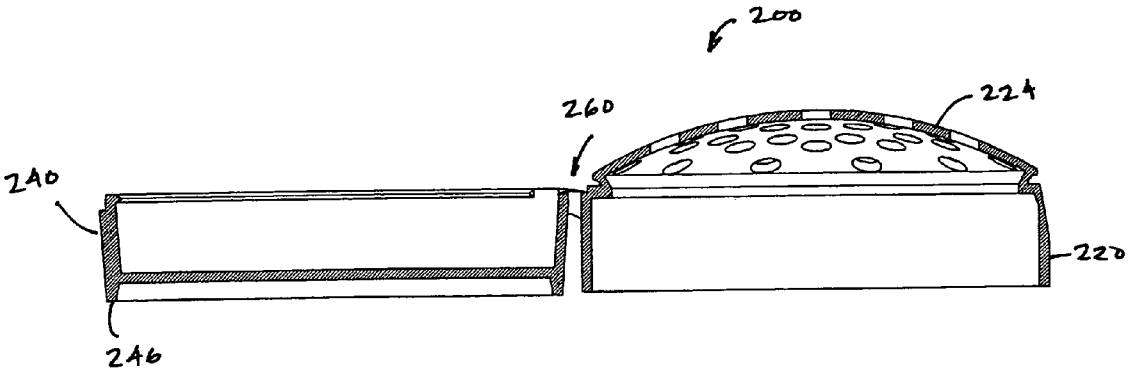

Referring further to FIGS. 2A through 2F, outer edge 30 includes a recess 34 configured to coact with a projection on the cover (to be further described) to form a retainer to retain the cover in a closed position relative to the top. According to one exemplary embodiment, recess 34 may be a single recess positioned generally opposite a hinge as shown schematically in FIGS. 2C and 4E. According to another exemplary embodiment, recess 34 may be several recesses provided in "segments" as shown schematically in FIGS. 2D and 4D. According to a further exemplary embodiment, recess 34 may be a substantially continuous recess as shown schematically in FIGS. 2E and 4C.

Referring further to FIGS. 2A through 2F, cover 40 is shaped having a contour (e.g. shape, form, etc.) that corresponds generally with top 24 to cover dispensing apertures 28 when cover 40 is in the closed position. According to a particularly preferred embodiment, cover 40 is contoured as a "dome" with a correspondingly planar central portion having a close fit (e.g. "nest", "glove-fit" etc.) with top 24. Cover 40 has an outer edge 42 that is configured to "fit" within ledge 32 to provide a generally smooth and uniform outer surface and appearance with base 20. Outer edge 42 has an inwardly extending projection 44 (e.g. bump, ridge, rib, nub, etc.) configured to engage recess 34 in a progressive frictional fit to form a "retainer" for holding the cover in the closed position (shown schematically in FIGS. 4C through 4E). Base 20 is provided with an indentation 38 (e.g. notch, cut-out, etc.) configured to correspond with an indentation 48 on cover 40 to provide an edge on the cover to facilitate opening the cover when the projection and the recess are engaged to form the retainer.

Referring to FIG. 2B, base 20 and cover 40 are joined by a hinge 60 (e.g. coupler, joint, etc.) for pivotal movement of the cover between the open position and the closed position (e.g. about an axis that is substantially tangent to the base). According to a particularly preferred embodiment, hinge 60 is integrally formed with base 20 and cover 40 in an injection molding process to provide a relatively thin "web" 62 of material extending between base 20 and cover 40 (to be further described in reference to FIGS. 7A through 7E). Base 20 and cover 40 have suitable recesses to accommodate the thickness of the web when the cover is in the closed position to provide a substantially smooth and uniform external surface. The integral formation of the base, top, cover, and hinge is intended to prevent loss or misplacement of the cover (although if the hinge fails or tears the cover may still be capable of attachment over or to the base or container).

Figure 3A:
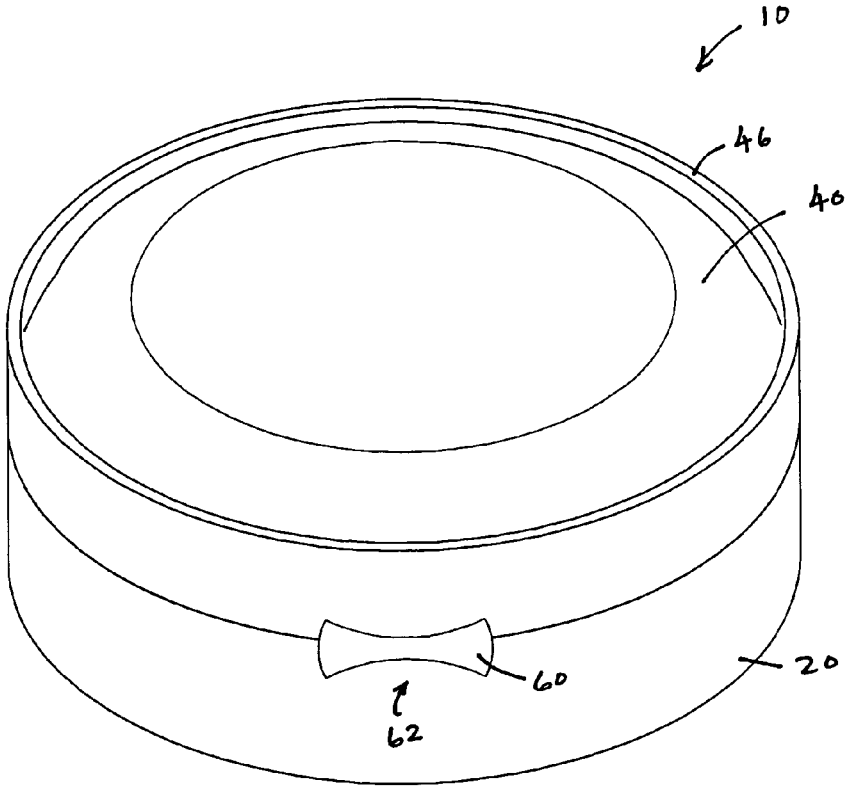
FIGS. 3A through 3E are schematic views of an improved closure for a container according to another preferred embodiment.
Figure 3B:
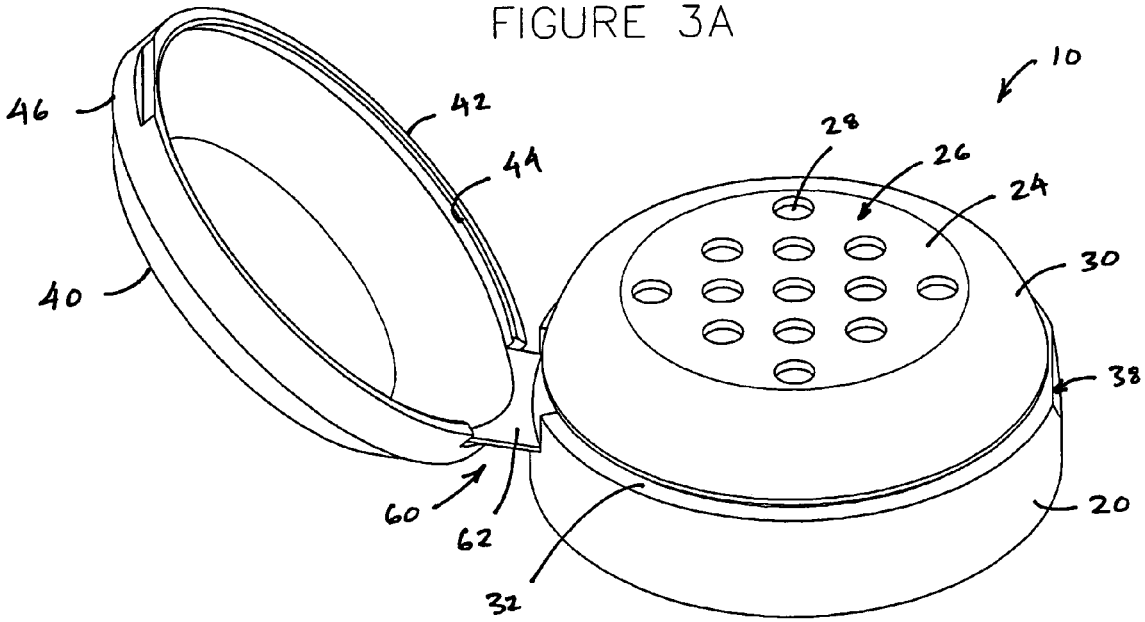
Figure 3C:
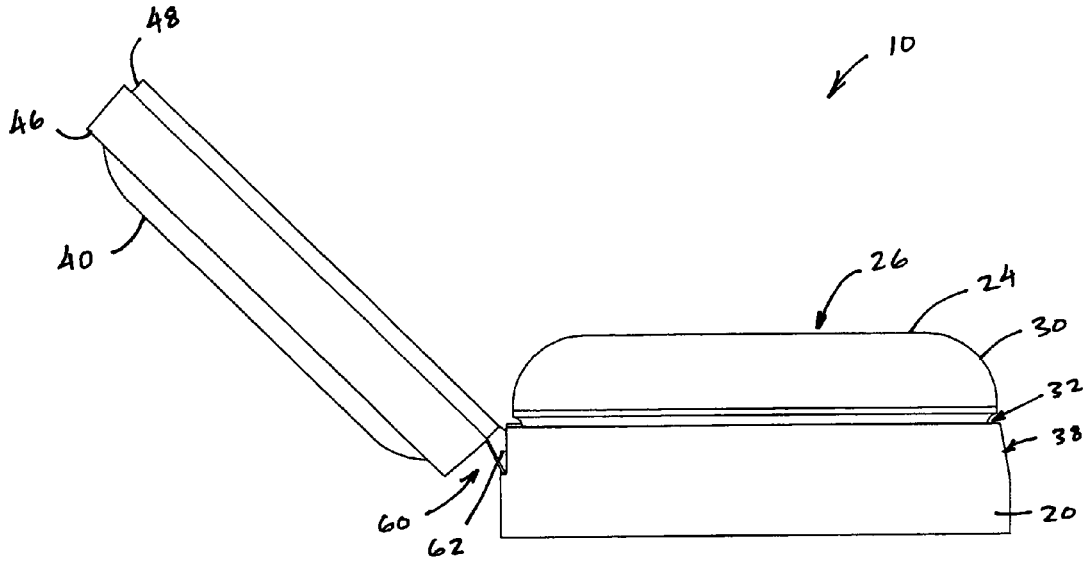
Figure 3D:
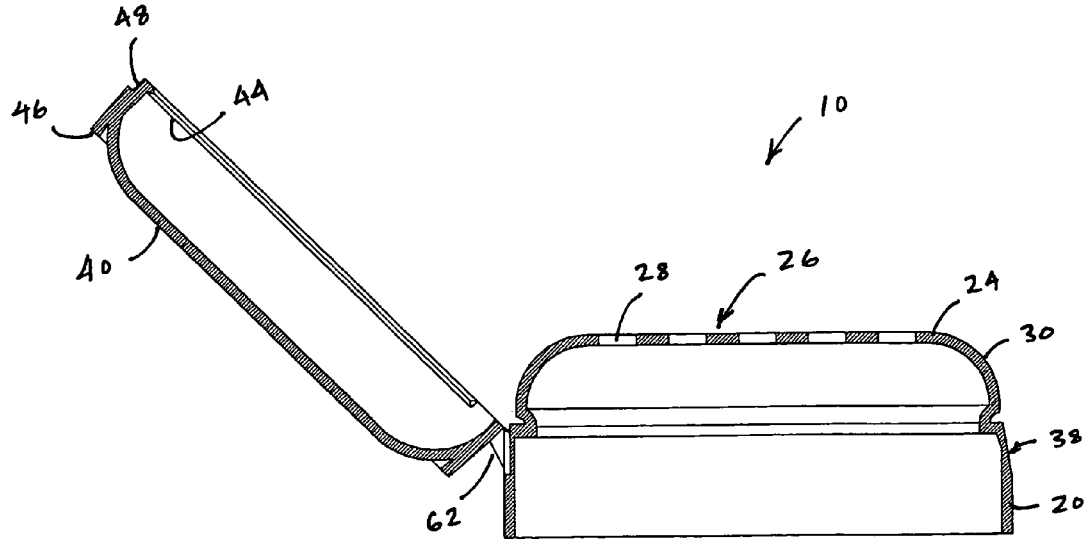
Figure 3E:
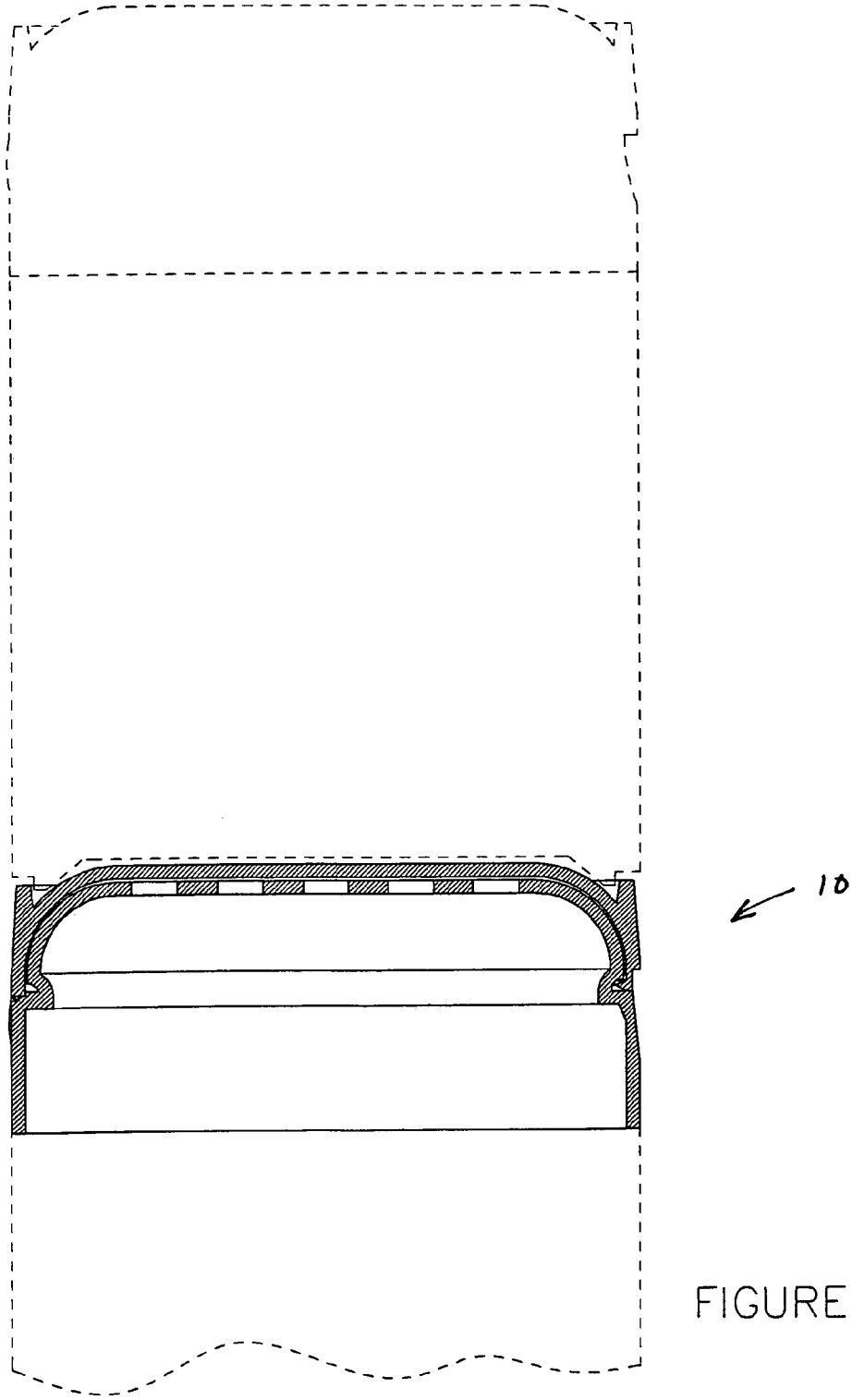

According to an alternative embodiment, the recesses and projections may be provided in any suitable configuration about the outer edge of the top to provide the desired retention of the cover to the base. According to another alternative embodiment, the top and cover may have any suitable shape or contour, including a shape or contour that is flat, rounded, cone-shaped or truncated cone-shaped, frustoconical, hemispherical, etc. The contour of the cover may match the contour of the top (see FIG. 3E), which will tend to reduce spillage or leakage of matter through the apertures when or if the container is bumped or knocked over to the side.

Referring to FIGS. 3A–3E, an improved closure for a container is shown according to another preferred embodiment. Closure 10 may have a cover with an upwardly extending projection (shown schematically as a lip 46, or ring, ridge, rib, etc. having a generally rectangular cross section with an inwardly angled or sloped wall to facilitate release from a mold, e.g. "draft" etc.). According to a particularly preferred embodiment, lip 46 extends upward from outer edge 42 of cover 40 (shown schematically as a continuous lip) to provide a generally smooth outer surface of the closure and to provide structure that tends to facilitate vertical stacking of like containers one atop another (as shown schematically in FIG. 3E). According to an alternative embodiment, the lip may be provided in several segments that may each have end regions that transition to the top surface of the cover (e.g. sloped, rounded, curved, etc.). According to another alternative embodiment, the cross-sectional shape of the lip may be any suitable shape to engage a bottom surface of a container to facilitate stacking (e.g. rounded, flat, angled, etc.).

Referring to FIGS. 4A, 4B and 4F–4H, a retainer for an improved closure for a container is shown according to another preferred embodiment. Cover 40 includes a projection 50 (shown schematically as a center projection in FIGS. 4B and 4G) or several projections 50 (shown schematically in FIGS. 4A, 4F and 4H) that extend downwardly from an underside of cover 40 and are configured to engage one or more of dispensing apertures 28 in a progressive frictional fit. According to a particularly preferred embodiment, projections 50 are integrally formed with the cover in an injection molding operation and have a cross-sectional shape the corresponds to the shape of the dispensing apertures and may have an interior that is hollow (as shown) or solid. When the cover is moved to a closed position, the projections tend to "clear" any residual matter that may have accumulated in the dispensing openings. According to an alternative embodiment, a single projection may be configured to engage any of the dispensing aperture(s), such as an aperture that is furthermost opposite the hinge or centrally located on the dispensing surface. According to another alternative embodiment, several projections may be provided in a pattern configured to engage all, or a selected portion, of the dispensing apertures. According to a further alternative embodiment, the projection may be an angularly extending projection or skirt (e.g. tab, rib, flap, etc.) and may include a curved leading edge that is configured to engage an edge of a dispensing aperture in a progressive frictional fit. According to a further alternative embodiment, the projection may have a feature or structure (e.g. rib, ring, barb, nub, etc.) extending around all or a portion of a lower end and intended to enhance or supplement the frictional engagement of the projection within the dispensing aperture.

Referring to FIGS. 5A through 5H, an improved closure for a container is shown according to another preferred embodiment. Closure 100 comprises a base 120, a top 124, and a cover 140. According to a particularly preferred embodiment, top 124 has a contour in the form of a frustoconical or truncated cone shape (as shown schematically in FIGS. 5C through 5G). Cover 140 has a generally flat surface substantially planar with the "flat" portion of top 124 (shown schematically as surface 150 in FIGS. 5C through 5H). Cover 140 may be provided with a generally smooth, flat surface (as shown schematically in FIG. 5A) or may be provided with an upwardly extending projection 146 (as shown schematically in FIGS. 5B and 5F) configured for stacking of like containers atop the cover. The closure may further comprise a hinge, an indentation, a pattern of dispensing apertures and a retainer as previously described. According to an alternative embodiment, the cover may be contoured in the form of a frustoconical or cone shape and configured to nest or otherwise provide a close fit with the top.

Referring to FIGS. 6A through 6F, an improved closure for a container is shown according to another preferred embodiment. Closure 200 comprises a base 220, a top 224, and a cover 240. According to a particularly preferred embodiment, top 224 has a contour in the form of a dome or convex shape (as shown schematically in FIGS. 6A through 6E). Cover 240 is provided with a generally smooth, flat surface (as shown schematically in FIGS. 6B and 6E) or may be provided with an upwardly extending projection 246 (as shown schematically in FIGS. 6C and 6D) configured for stacking of like containers atop cover 240. Closure 200 further comprises a hinge, an indentation, a pattern of dispensing apertures and a retainer as previously described. According to an alternative embodiment, the cover may be contoured in the form of a "dome" (full or partial) or convex shape and configured to nest or otherwise provide a close fit with the top.

Referring to FIGS. 7A through 7E, a hinge for an improved closure for a container is described according to a preferred embodiment. Hinge 260 is integrally formed with base 220 and cover 240 in an injection molding process to provide a "web" 262 of material extending between base 220 and cover 240. Base 220 and cover 240 have suitable recesses to accommodate the thickness of the web when the cover is in the closed position to provide a substantially smooth and uniform external surface. The substantially smooth and uniform external surface is intended to cooperate with equipment for installing the closure on a container (e.g. soft rollers, etc.). According to a particularly preferred embodiment, web 262 has a generally curved upper edge 264 and a generally curved lower edge 266 (e.g. defined at least partially by the curvature of the walls of the base and the cover) that result in a relatively narrow central portion and relatively wider end portions (e.g. "bow-tie" shape, x-shape, etc. as shown schematically in FIG. 7C). The configuration of hinge 260 permits hinge 260 to flex in a side-to-side manner (e.g. about an axis perpendicular to a tangent of the base) that is intended to provide a more rugged design that can accommodate a degree of distortion (e.g. "twisting", etc.) of the cover (as shown schematically in FIGS. 7A and 7B). Cover 240, web 262, and base 220 are integrally formed such that the curved upper edge 264 is coupled to cover 240 and the curved lower edge 266 is coupled to base 220. This arrangement provides a pivot that permits web 262 to pivot relative to base 220 and cover 240 when the cover is moved between an open and a closed position. The web and the curved upper and lower edge also result in the hinge acting as an "over-center" device (e.g. spring, etc.) that tends to bias the cover toward the open position when the cover is moved beyond the "over-center" point to hold the cover away from matter being dispensed when the container is in a dispensing position. The "over-center" device also tends to assist closure of the cover when the cover is moved in a closed direction beyond the "over-center" point.

Figure 12A:
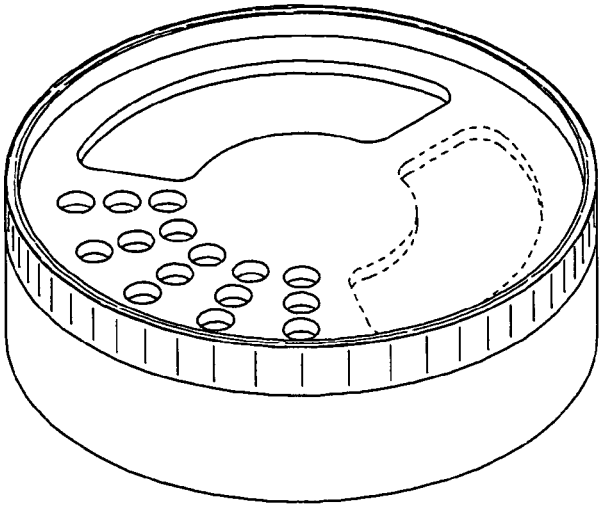
FIGS. 12A through 12F are schematic views of an improved closure for a container according to another preferred embodiment.
Figure 12B:
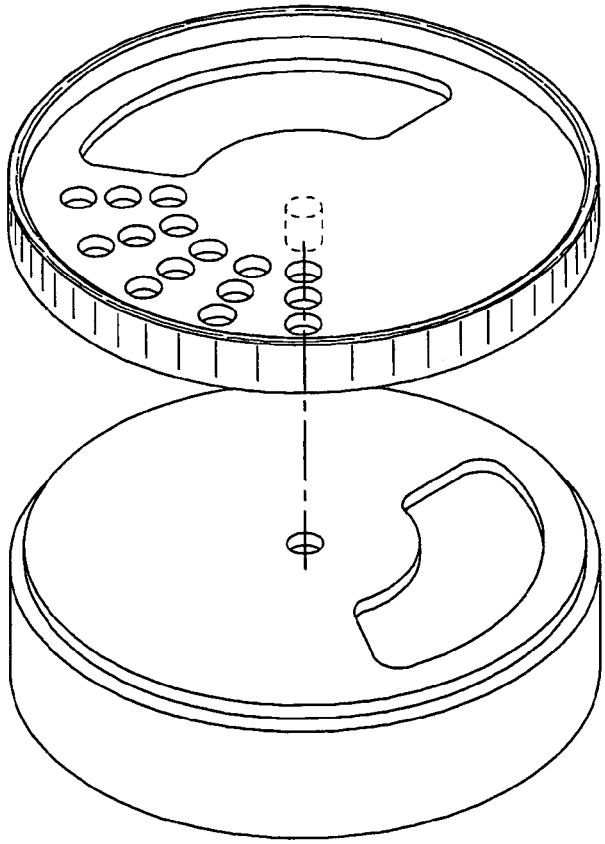
Figure 12C:
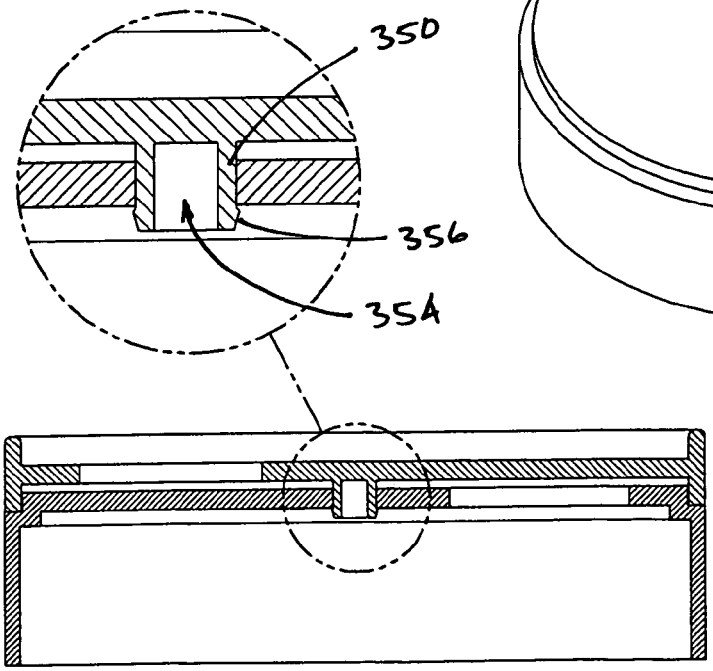
Figure 12D:
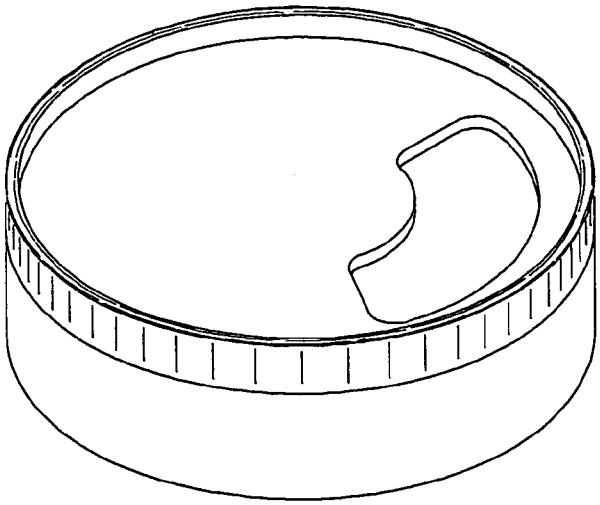
Figure 12E:
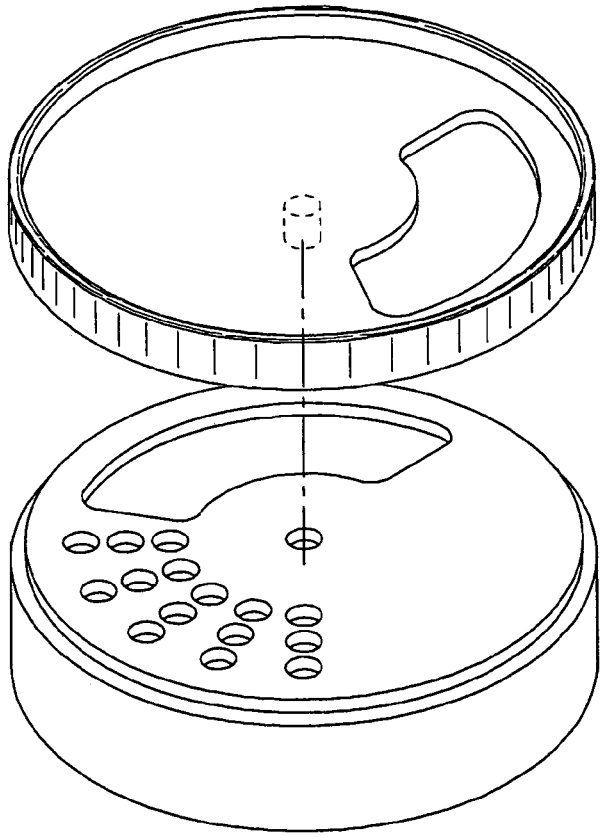
Figure 12F:
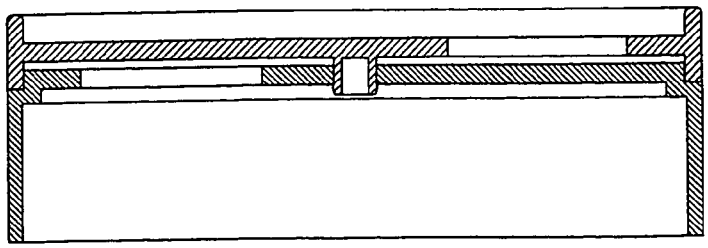
Figure 14A:
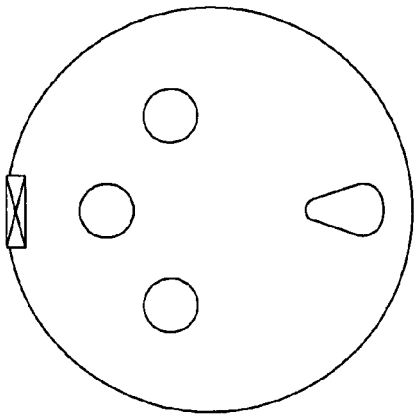
FIGS. 14A through 14G are schematic views of an improved closure for a container according to another preferred embodiment.
Figure 14B:
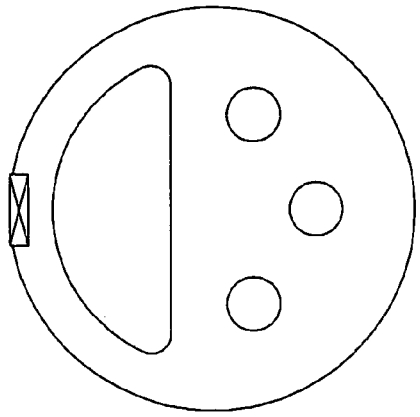
Figure 14C:
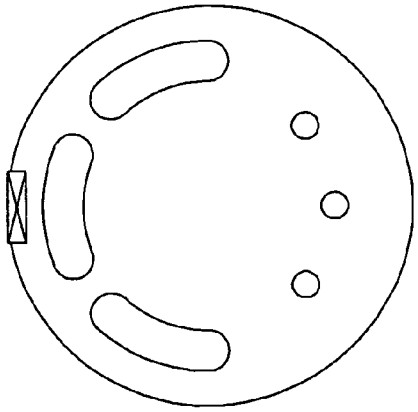
Figure 14D:
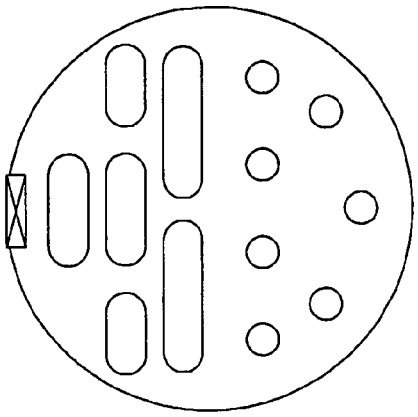
Figure 14E:
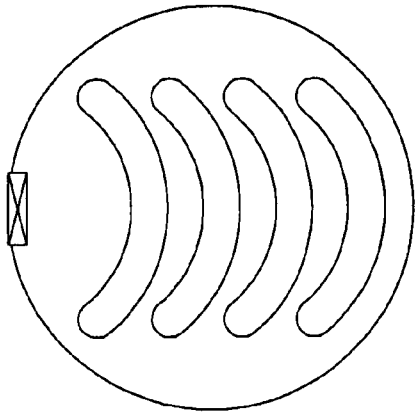
Figure 14F:
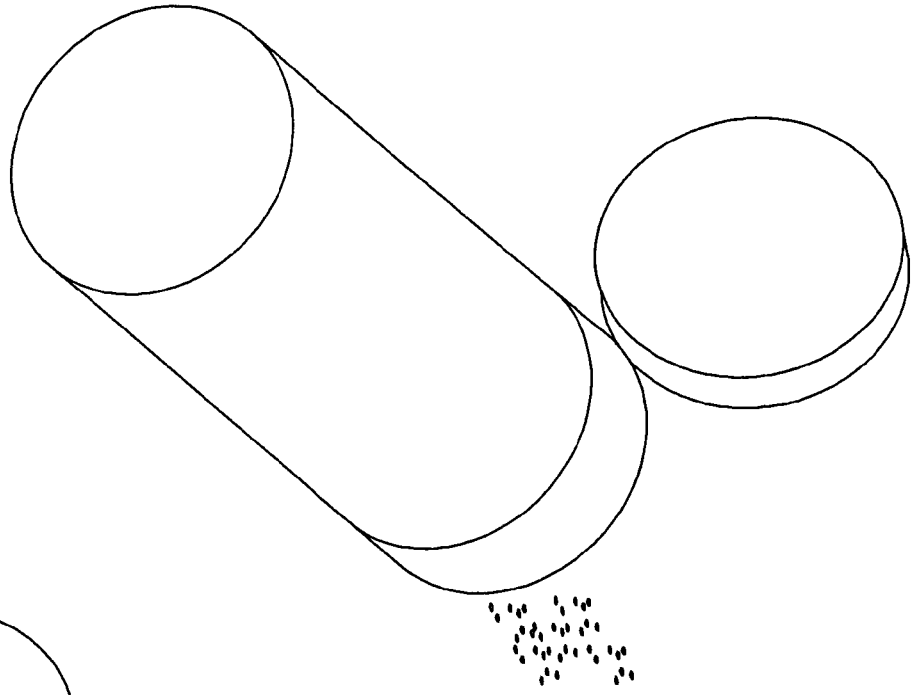
Figure 14G:
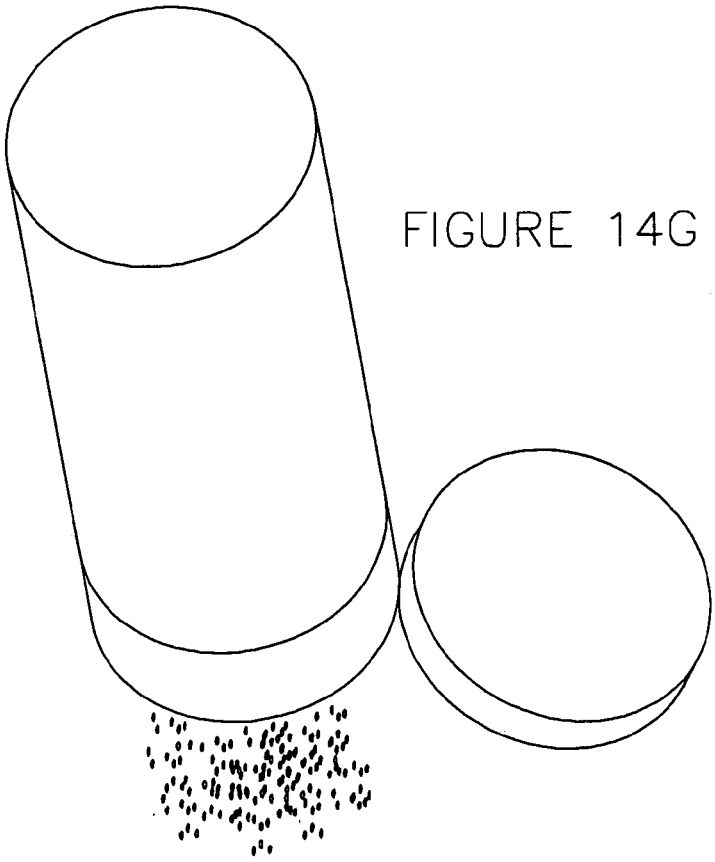

Referring to FIGS. 8A through 8F, an improved closure for a container is shown according to another preferred embodiment. Closure 300 includes a base 320, a top 324 having a pattern of dispensing apertures 328 (shown schematically as a pattern of circular holes and a curved slot in FIG. 8D) and a cover 340 (e.g. dial, etc.) coupled adjacent to top 324 for movement about the top. According to a particularly preferred embodiment, top 324 and cover 340 are formed in a convex or dome shape in a nesting relationship (shown schematically in FIG. 8F). Cover 340 includes a downwardly exteriding projection 350 (e.g. post, axle, pivot, etc.) configured to engage a boss 352 in top 324 for rotational movement of cover 340 about top 324 in a close-fitting relationship (shown schematically in FIGS. 8C and 8F). Projection 350 is shown schematically as a circular post and includes a slot 354 and a keeper 356 (e.g. annular projection, circumferential rib, barb, etc.) as shown schematically in FIG. 12C, or other suitable structure to permit the cover to be coupled to the top for rotational movement. Cover 340 includes a gripping surface 358 (e.g. textured area, serrated area, ribs, etc.) that may be integrally molded on the cover and that is intended to facilitate gripping by a user for moving the cover relative to the top.

Referring further to FIGS. 8A through 8F, cover 340 comprises a pattern of dispensing aperture(s) 388 (shown schematically as a curved slot in FIGS. 8A through 8C) configured to align with a portion or all of the pattern of circular holes in the top (shown schematically in FIG. 8B), or to align with a portion or all of the curved slot in the top (as shown schematically in FIG. 8C), or to align with a combination of a portion of the pattern of circular holes and a portion of the curved slot (not shown). The amount of matter dispensed from the closure can be adjusted by rotating the cover to align with the desired pattern of dispensing apertures. An underside of cover 340 has a downwardly extending projection (e.g. skirt, rib, etc.—shown schematically as a radially extending straight skirt 370 in FIG. 8F) configured to engage the surface of top 324 to collect or "sweep" residual matter that may remain on the surface of top 324 following the dispensing of matter from the container. As cover 340 is rotated about top 324, matter is "collected" by skirt 370 and urged toward one or more of the pattern of dispensing openings in the top where the matter may be returned to the container. Closure 300 further comprises an upwardly extending projection 346 to facilitate stacking of like containers. According to an alternative embodiment, the skirt extending from the underside of the cover for collecting residual matter may be provided in any suitable configuration (e.g. it may have various slants or curves, etc.) for urging residual matter toward the pattern of dispensing openings.

Figure 8A:
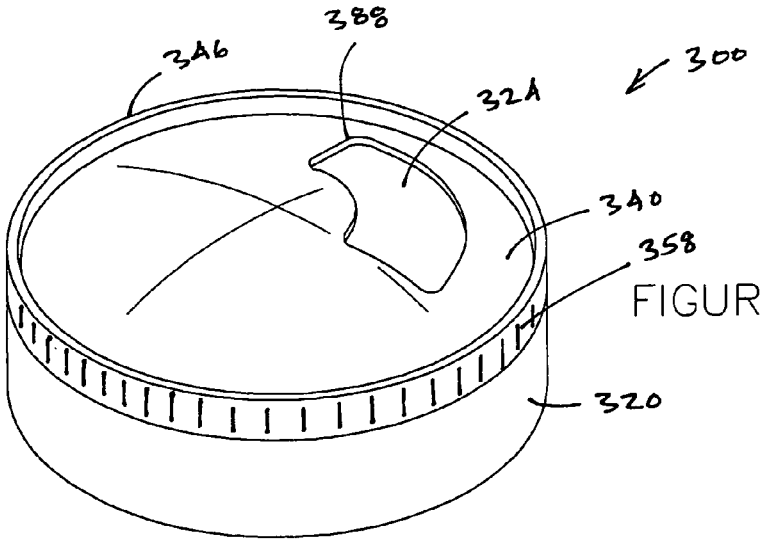
FIGS. 8A through 8F are schematic views of an improved closure for a container according to another preferred embodiment.
Figure 8B:
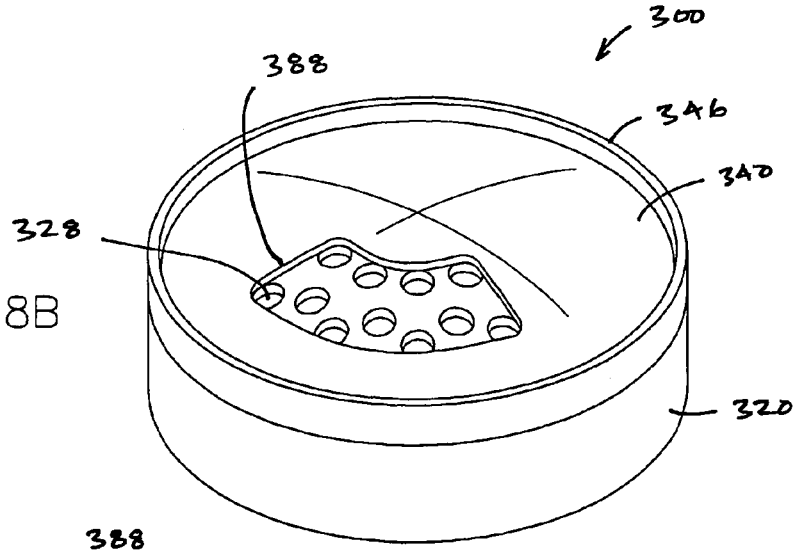
Figure 8C:
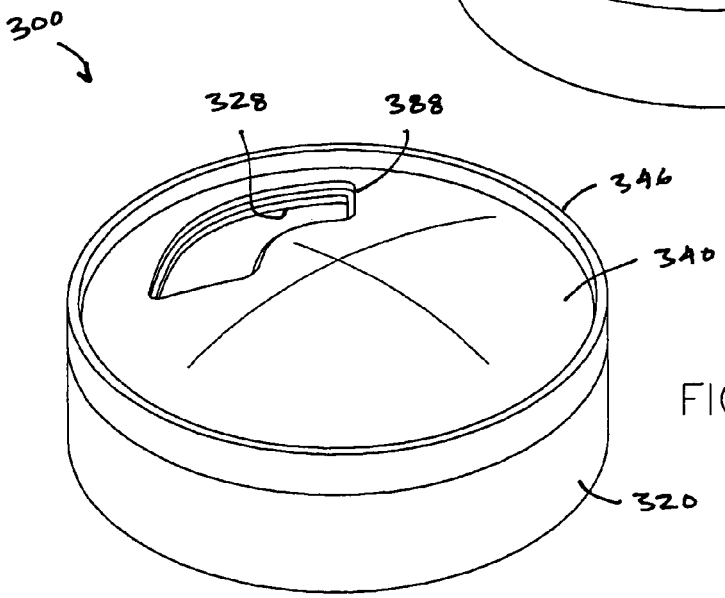
Figure 8D:
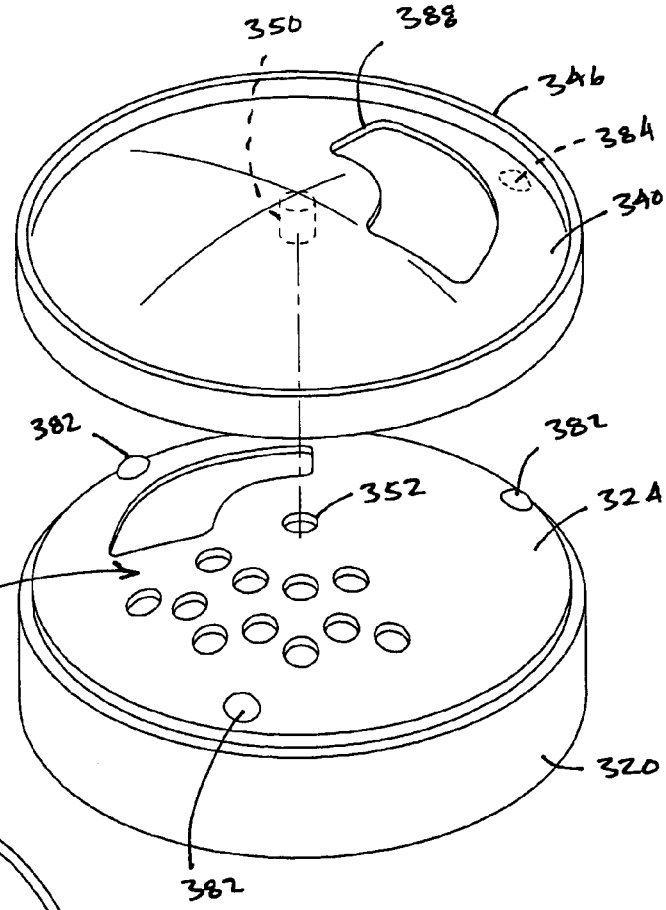
Figure 8E:
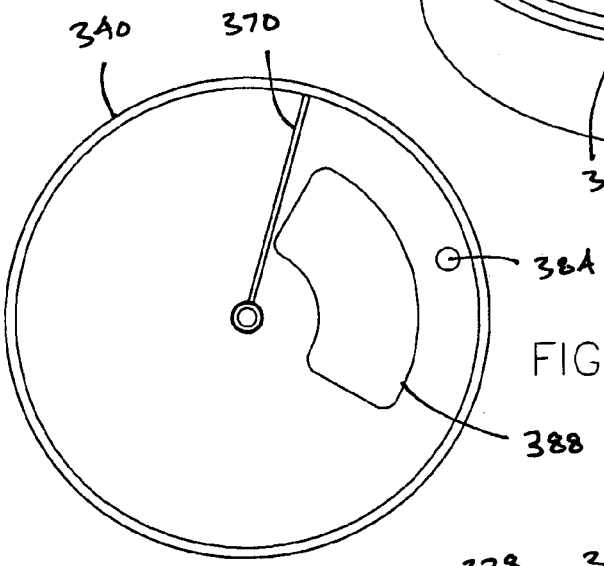
Figure 8F:
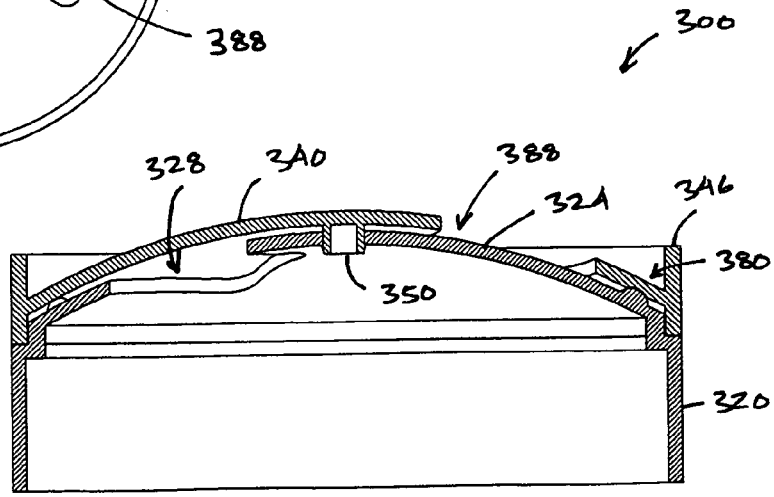
Figure 9A:
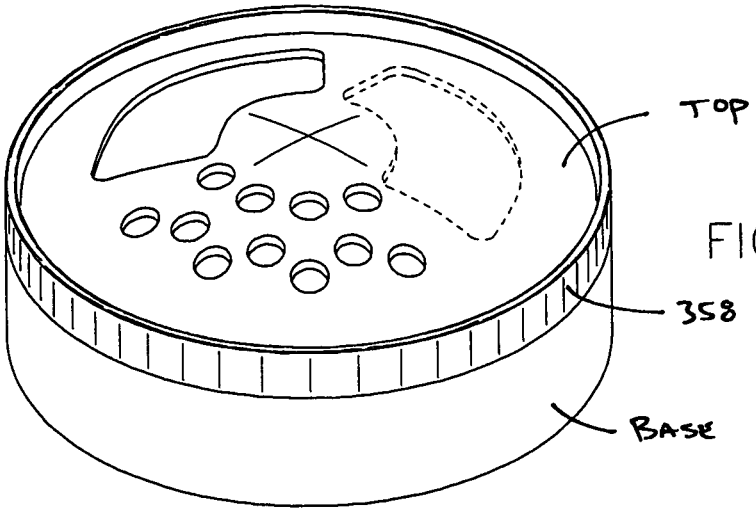
FIGS. 9A through 9D are schematic views of an improved closure for a container according to another preferred embodiment.
Figure 9B:
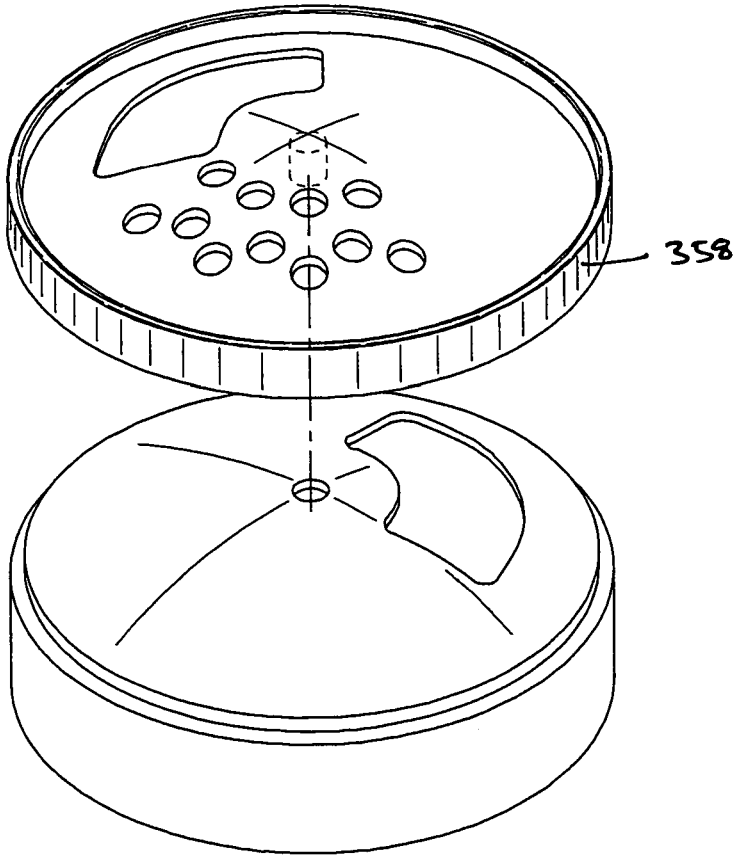
Figure 9C:
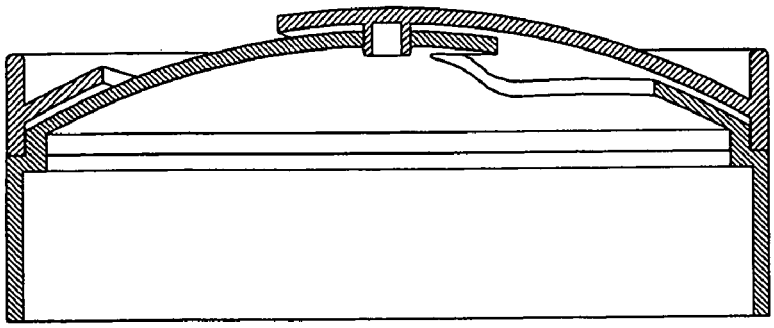
Figure 9D:
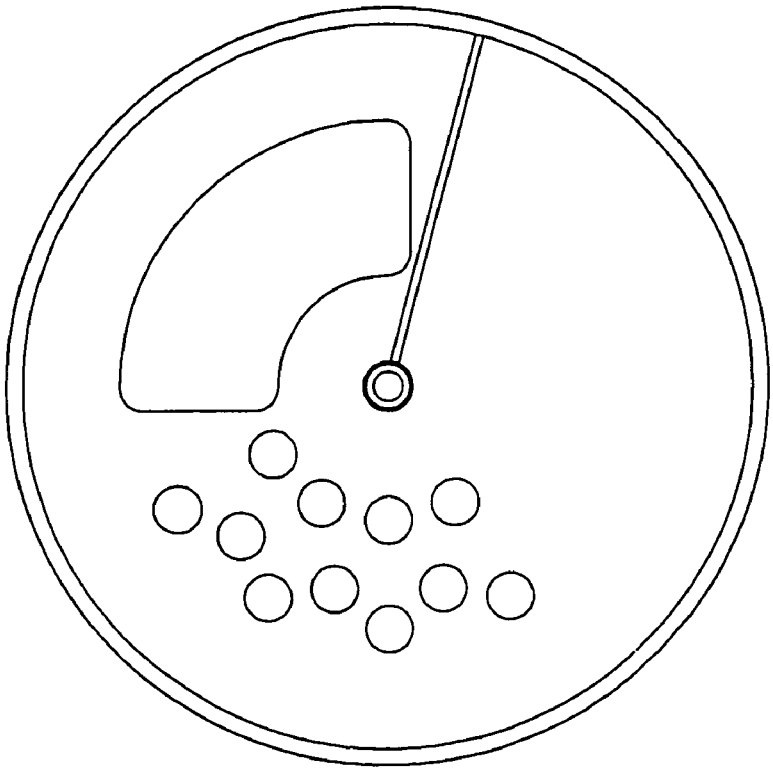
Figure 10A:
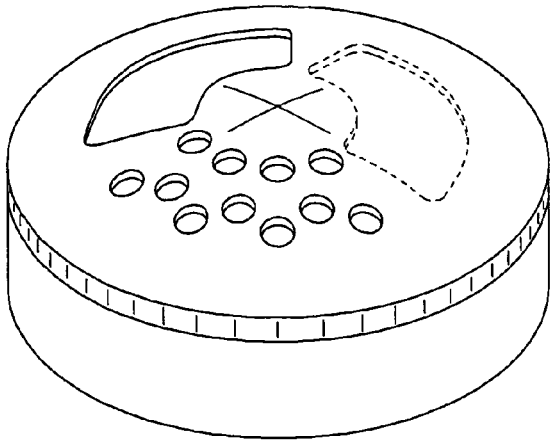
FIGS. 10A through 10F are schematic views of an improved closure for a container according to another preferred embodiment.
Figure 10B:
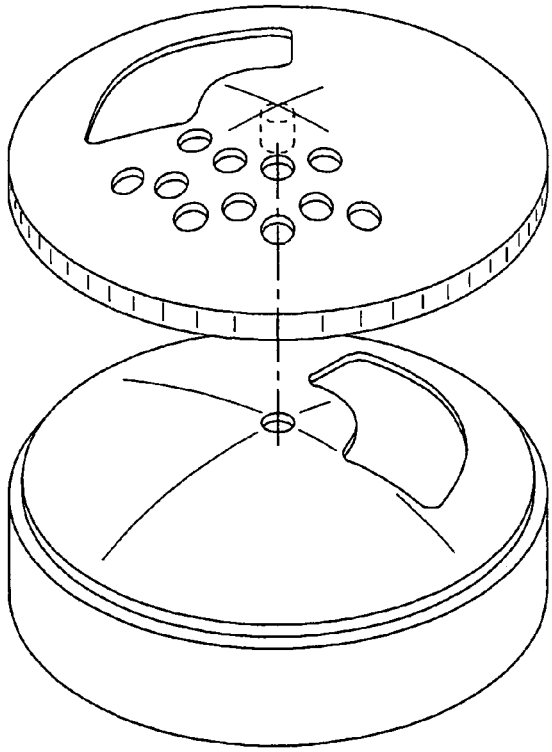
Figure 10C:
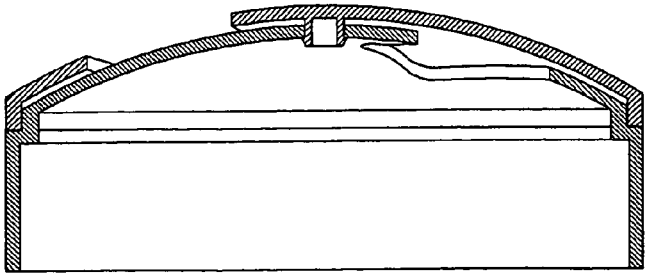
Figure 10D:
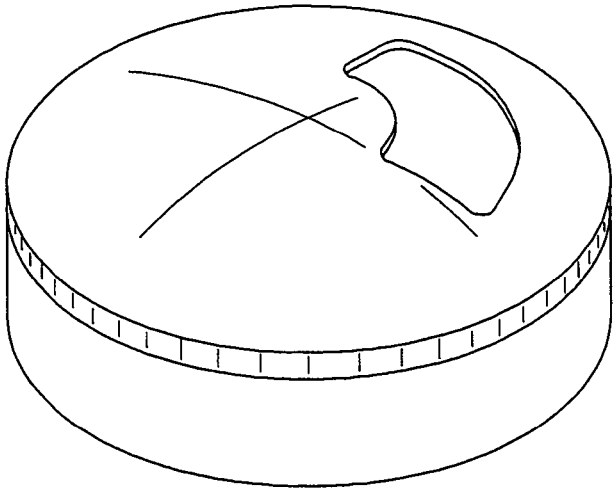
Figure 10E:
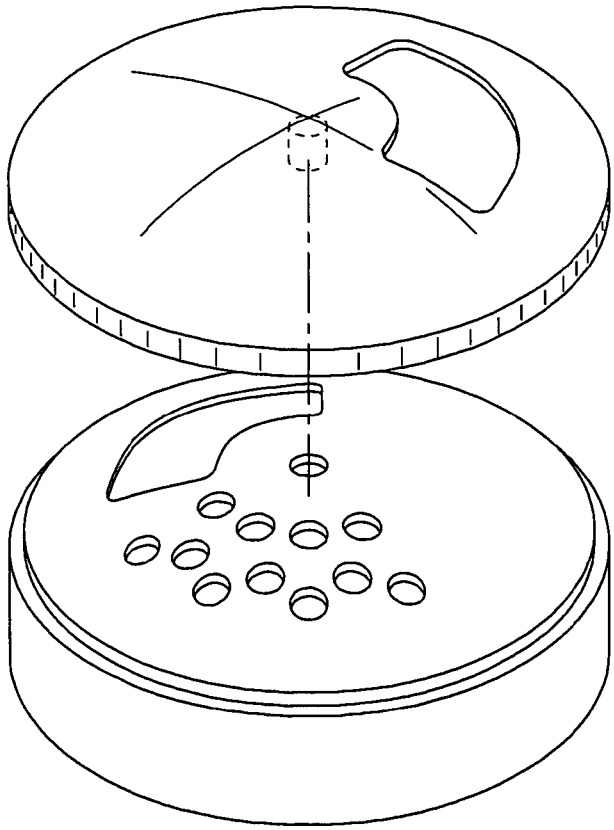
Figure 10F:
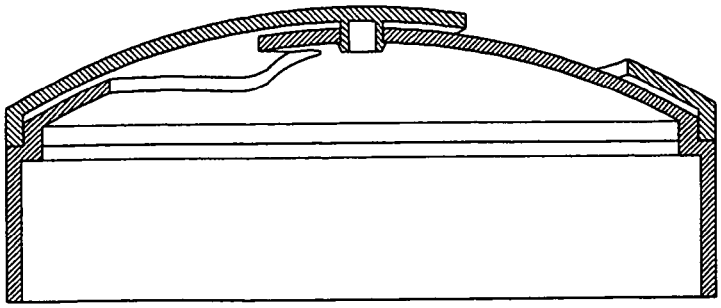

Referring further to FIGS. 8D and 8E, a positioning device for closure 300 is shown according to a preferred embodiment. Positioning device 380 includes one or more projections 382 (e.g. bumps, "speed-bumps", lobes, etc.—shown schematically as three projections in FIG. 8D) extending upward from top 324 and a recess 384 (e.g. dimple, depression, etc.) on an underside of cover 340. Projections 382 and recess 384 are configured for engagement when cover 340 is moved relative to top 324 to provide one or more locations in which the cover may be temporarily "positioned" relative to the top. According to a particularly preferred embodiment, projections 382 and recess 384 are configured for engagement at particular locations to provide a "closed" position, a "pour" position, a "shaker" position, and a combined "pour" and "shaker" position. For example, the projections and recess may be configured such that the curved slot in cover 340 is not aligned with any of the pattern of dispensing apertures (e.g. the "closed" position as shown in FIG. 8A), is aligned with the curved slot in top 324 (e.g. the "pour" position" as shown in FIG. 8C), is aligned with the pattern of circular apertures in top 324 (e.g. the "shaker" position as shown in FIG. 8B), or is aligned with a combination of the curved slot and the pattern of circular apertures in top 324 (e.g. the combined "shaker" and "pour" position). According to any preferred embodiment, the positioning device is intended to permit the cover to be temporarily retained in the closed position or in one of a variety of other positions. According to an alternative embodiment, the orientation of the projections and recess may be reversed so that the projections extend from an underside of the cover and the recess is provided within the top. According to another alternative embodiment, a single projection may be provided and configured to engage one or more recesses. According to a further alternative embodiment, the projections and recess may be located at any suitable position on the top and the cover.

Referring to FIGS. 9A through 9D, an improved closure for a container is shown according to another preferred embodiment. The closure is similar to closure 300 (as shown schematically in FIGS. 8A through 8F), however the relative orientation of the pattern of dispensing apertures in the top and cover are reversed so that the top provides a pattern of apertures comprising a curved slot and the cover provides a pattern of dispensing aperture(s) comprising a pattern of circular holes and a curved slot.

Referring to FIGS. 10A through 10F, an improved closure for a container is shown according to an improved embodiment. The closure is similar to closure 300 (as shown schematically in FIGS. 8A through 8F), however, the cover may be provided without an upwardly extending projection for applications in which stacking of like containers atop the cover is not desired.

Figure 11A:
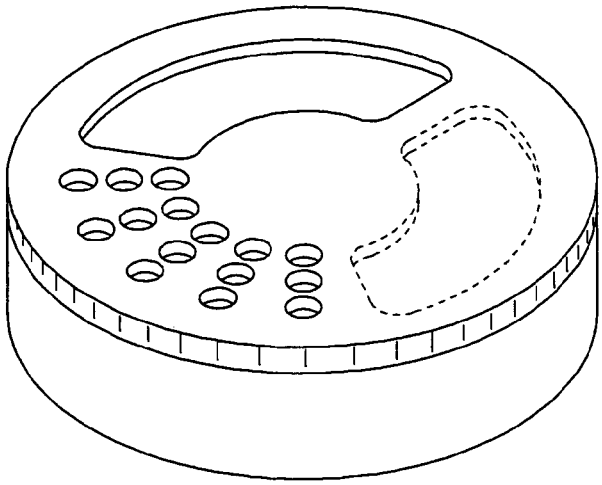
FIGS. 11A through 11F are schematic views of an improved closure for a container according to another preferred embodiment.
Figure 11B:
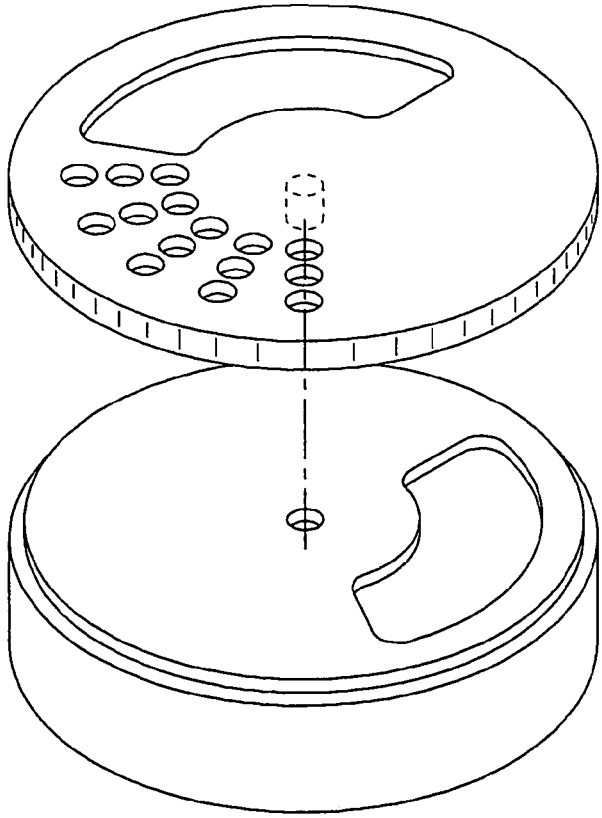
Figure 11C:
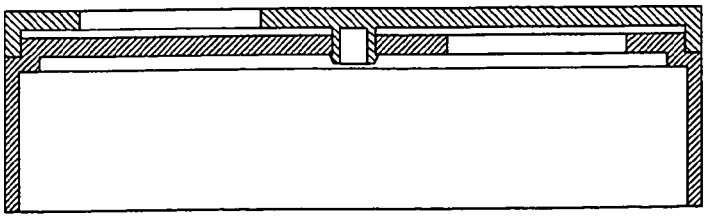
Figure 11D:
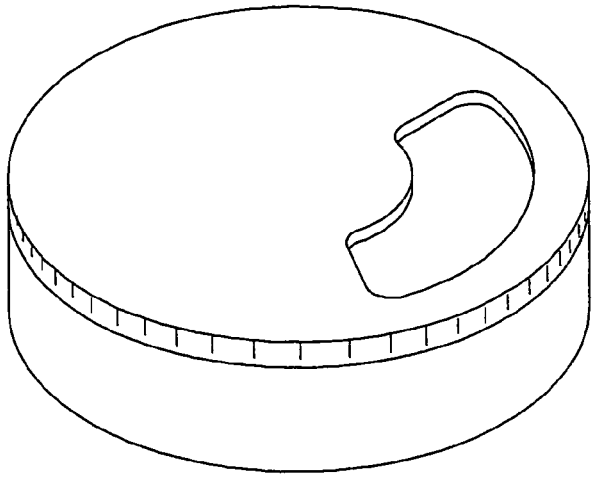
Figure 11E:
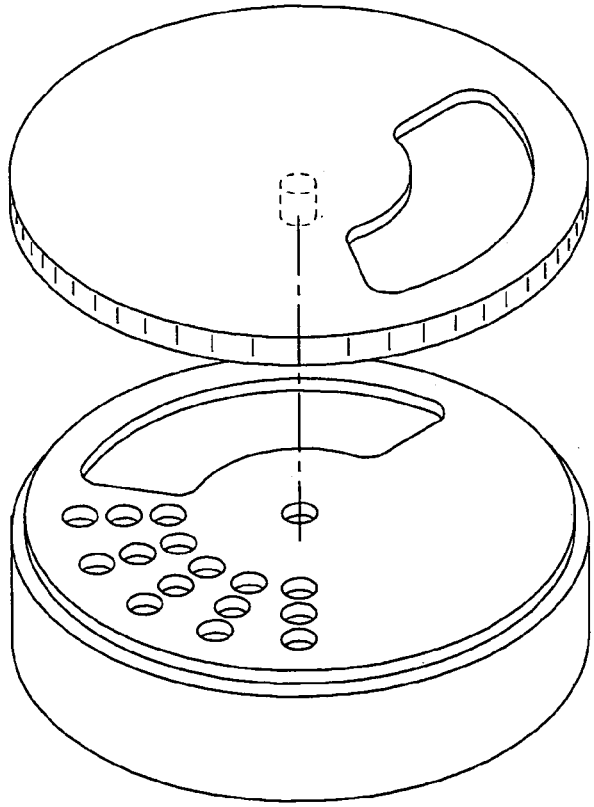
Figure 11F:
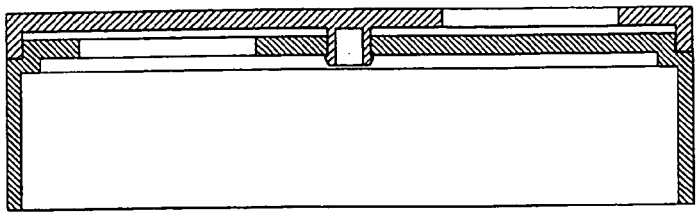

Referring to FIGS. 1A through 11C, an improved closure for a container is shown according to another preferred embodiment. The closure is similar to closure 300 (as shown schematically in FIGS. 8A through 8F), however, the top and cover may be provided having a shape that is substantially flat and without an upwardly extending projection for applications in which stacking of like containers atop the cover is not desired. Referring to FIGS. 11D through 11F, the closure is shown having the orientation of the pattern of dispensing apertures on the cover and the top reversed. According to an alternative embodiment, the top and cover may be provided in any suitable contour, such as a cone shape, a frustoconical shape, a dome shape having a planar central portion, etc.

Referring to FIGS. 12A through 12F, an improved closure for a container is shown according to another preferred embodiment. The closure is similar to the closure shown schematically in FIGS. 11A through 11F, however the cover may be provided with an upwardly extending projection (e.g. lip, etc.) for stacking of like containers.

Referring to FIGS. 13A and 13B, an improved closure for a container is shown according to another preferred embodiment. Closure 400 includes a base 420, a top 424 having a contour formed in a convex or dome shape and coupled at or adjacent a side wall or edge of base 420 and defining a pattern of dispensing apertures 428, and a cover 440 coupled to top 424 for movement between an open position and a closed position. Top 424 has a first coupling structure configured to coact with a second coupling structure on cover 440 to form a hinge. According to a particularly preferred embodiment, the first coupling structure on top 424 is one or more projections 412 (e.g. extensions, posts, legs, pegs, etc.—shown schematically as two parallel projections positioned near an outer edge of the top in FIGS. 13A and 13B) and the second coupling structure on cover 440 is one or more recesses 414 (e.g. cavities, holes, pockets, cups, etc.—shown schematically as two parallel recesses positioned near an outer edge of the cover in FIGS. 13A and 13B) that are configured to coact with the projections to provide pivotal movement of the cover relative to the top between the open position and the closed position.

Referring further to FIGS. 13A and 13B, projections 412 and recesses 414 may have suitable engagement structure (e.g. ribs, barbs, grooves, detents, etc.—not shown) for securing projections 412 and recesses 414 in a pivotal relationship. Projections and recesses may also have suitable structure (e.g. frictional fit, detents, etc.—not shown) for holding the cover in the open position during the dispensing of matter from the container. Closure 400 further comprises an indentation to facilitate the opening of the cover, and a retainer (e.g. a single retainer, a retainer in multiple segments, or a continuous retainer as previously described in reference to FIGS. 4C through 4E or FIGS. 4F through 4H). According to an alternative embodiment, the top may have any suitable contour for use in dispensing matter from the container (e.g., flat, cone shaped, frustoconical, dome shaped with a generally planar central portion, etc.). According to another alternative embodiment, cover 440 may have an upwardly extending projection to facilitate stacking of a like container. According to a further alternative embodiment, the position of the first and second coupling structure may be spaced inwardly from an outer edge of the top and cover. According to a further alternative embodiment, the projections and recesses may be provided in any suitable number (such as one, three, etc.) to form an effective hinge.

Referring to FIGS. 13C and 13D, an improved closure for a container is shown according to another preferred embodiment. The closure is similar to closure 400 (as shown and described in reference to FIGS. 13A and 13B), however, the orientation of the projections and recesses may be reversed so that the recesses are provided on the top and the projections extend downwardly from the cover.

Referring to FIGS. 14A through 14G, an improved closure for a container is shown according to another preferred embodiment. The closure has a top with a pattern of dispensing orifices for dispensing matter from the container. The pattern of dispensing orifices may be provided in any suitable pattern for dispensing matter from the container (e.g. substantially circular apertures of various sizes, elongated holes or slots formed in a straight or curved profile, oblong or "tear-drop" shaped apertures, "half-moon" shaped apertures, or any combination thereof as shown schematically by way of example in FIGS. 14A through 14E).

According to a particularly preferred embodiment, the pattern of dispensing apertures is arranged so that when the container is moved to a first dispensing position (e.g. tilted to a first degree, etc.—shown schematically in FIG. 14F) the amount of matter dispensed from the closure is a first quantity (e.g. relatively small quantity). When the container is moved to a second dispensing position (e.g. further tilted, inverted, etc.—shown schematically in FIG. 14G) the amount of matter dispensed from the container is a second quantity (e.g. relatively large quantity greater than the first quantity).

Referring further to FIGS. 14A through 14G, the pattern of dispensing apertures is intended to permit a user to adjust or regulate the rate at which matter is dispensed from the closure by changing the dispensing position of the container. The pattern of dispensing apertures may be configured to provide this feature by positioning apertures of relatively small size (or a small number of apertures) near a first side of the top that is lowermost when the container is in the first dispensing position (e.g. substantially opposite the hinge) and positioning apertures of relatively larger size (or a greater number of apertures) nearer the side opposite of the first side (e.g. substantially adjacent the hinge) so that matter from the container may be dispensed therethrough when the container is moved to the second dispensing position. According to any preferred embodiment, the pattern of dispensing apertures may be positioned and shaped to provide a "return" for matter that may (in use) otherwise accumulate on the top that will allow the accumulated matter to return to the container (e.g. by shaking or other appropriate manipulation of the upright container). For example, elongated arcuate apertures may be provided in the top at a location at least partially along an outer edge of the top to receive material that may have accumulated on the top (as shown schematically in FIG. 14C). According to an alternative embodiment, the apertures may be provided in any suitable shape and in any suitable pattern for dispensing matter of a particular type (e.g. coarse, medium or fine particulate or granulated matter, powders, etc.) from the container.

According to any preferred embodiment, the cap may be made of a moldable material (e.g. plastic, etc.) in a forming process (e.g. injection molding process, etc.). The moldable material (e.g. plastic, etc.) may be provided as a generally transparent material (e.g. clear, tinted, etc.), a generally opaque material (e.g. non-transparent, colored, etc.), or a combination of a transparent material (such as for the cover, etc.) and an opaque material (such as for the base, etc.). The moldable material may be other suitable moldable plastics or other suitable materials for molding a closure.

According to any preferred embodiment, the closure may be formed integrally, as a single unit, or in separate pieces that may be coupled together to form a closure. Closures that are integrally formed tend to reduce the number of manufacturing or assembly steps required and provide a more uniform appearance. Closures formed in separate pieces (e.g. two-piece, etc.) can generally be configured with a more complex combination of features because the use of separate molds for the pieces tends to reduce the complications resulting from the geometry of the features (such as interferences, undercuts, etc.) that may otherwise hinder the "releasability" of integrally formed closures from the mold. Closures formed in separate pieces also generally provide a more simplified flow path for the injected material which tends to reduce distortion factors (e.g. differential cooling rates, air pockets within the mold, etc.), seams or mold lines and other complications that are associated with mold development for one-piece closures. In sum, the constraints and design considerations that must be taken into account in each method of formation differ due to various molding considerations, including the number of required pieces in the molds, cooling considerations, the angles at which the molds are released from the molded part, mold wear, etc.

It is important to note that the construction and arrangement of the elements of the improved closure for a container provided herein are illustrative only. Although only a few exemplary embodiments of the present invention have been described in detail in this disclosure, those skilled in the art who review this disclosure will readily appreciate that many modifications are possible in these embodiments (such as variations in features such as components, bases, covers, hinges, dispensing surfaces, orientation and configuration of dispensing apertures, variations in sizes, structures, shapes, dimensions and proportions of the components of the improved closure for a container, use of materials, colors, contours, combinations of shapes, etc.) without materially departing from the novel teachings and advantages of the inventions. For example, the cover, base and hinge may be integrally formed in a single molding operation or process; the cover and dispensing surface may be configured for a "nest" or "glove" type fit or may provide for a space or degree of separation; the cover may be configured for pivoting movement relative to the base or may be configured for rotational movement relative to the base; the cover and base may be provided with a single retainer, multiple segments of a retainer, or a substantially continuous retainer; or dispensing apertures may be provided in any suitable pattern and in uniform or non-uniform size and spacing to suit a particular dispensing concept. Further, it is readily apparent that variations of the improved closure for a container may be provided in a wide variety of types, shapes, sizes, hinge configurations, and dispensing aperture patterns for use with a wide variety of containers sizes, shapes and appearances, and for a variety of matter to be stored within and dispensed from the container. Accordingly, all such modifications are intended to be within the scope of the inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. An integrally-formed closure for a container of a type including a receptacle having an open top and a closed bottom, the closure comprising:

a body comprising:

a generally cylindrical base configured to be coupled to the receptacle;

a top portion coupled to the base and including a dispensing aperture;

a recess extending around at least a portion of the periphery of the top portion; and a first element coupled to the top portion and located in the recess;

a cover coupled to the body for movement between a closed position in which the dispensing aperture is closed and an open position in which the dispensing aperture is open, the cover comprising:

a bottom surface;

a skirt extending downwardly from the outside edge of the bottom surface and configured to be received within the recess in the top portion when the cover is in the closed position;

a second element located on the skirt;

a projection extending from the bottom surface of the cover and configured to extend into the dispensing aperture of the top portion when the cover is in the closed position; and an annular projection extending from a top surface of the cover;

wherein the first element and the second element are configured to cooperate with one another to releasably retain the cover in the closed position.

2. The closure of claim 1 further comprising a hinge coupled to the periphery of the body and the periphery of the cover, wherein the hinge is configured so that the cover is pivotable between the closed position and the open position about an axis generally tangent to the base.

3. The closure of claim 2 wherein the hinge comprises a web extending between the cover and the body, the web including a generally curved upper edge and a generally curved lower edge.

4. The closure of claim 2 wherein the hinge is recessed within at least one of the body and the cover when the cover is in the closed position.

5. The closure of claim 1 wherein the bottom surface of the cover is adjacent the top portion of the body when the cover is in the closed position.

6. The closure of claim 1 wherein the first element is a first projection and the second element is a second projection and wherein the first projection and the second projection extend in opposite radial directions.

7. The closure of claim 6 wherein the first projection is configured to at least partially interfere with the second projection when the cover is moved into the closed position, and wherein the interference between the first projection and the second projection retains the cover in the closed position until the cover is opened by a user.

8. The closure of claim 1 wherein the dispensing aperture is a plurality of dispensing apertures.

9. The closure of claim 8 wherein the projection extending from the bottom surface of the cover is a plurality of projections extending from the bottom surface of the cover.

10. The closure of claim 1 wherein the body comprises an indentation near the recess and wherein the cover extends radially outward over the indentation to provide a surface for facilitating the movement of the cover from the closed position to the open position.

11. The closure of claim 1 wherein when the cover is in the closed position, the skirt and the base provide a generally smooth and uniform appearance.

12. The closure of claim 1 wherein the annular projection extends from an outer edge of the cover.

13. An integrally-formed closure for a container of a type including a receptacle having an open top, a closed bottom, and a threaded neck configured to receive the closure, the closure comprising:

a body comprising:

a generally cylindrical base including a thread configured to engage the threaded neck of the receptacle;

a top portion coupled to the base, the top portion having a first contour and including a dispensing aperture;

a recess extending around at least a portion of the periphery of the top portion;

a first element located in the recess; and an indentation in the base near the recess;

a cover comprising:

a bottom surface having a second contour;

a downwardly extending skirt configured to be received within the recess in the top portion when the cover is in a closed position;

a second element located on the skirt;

a projection extending from the bottom surface of the cover and configured to extend into the dispensing aperture of the top portion when the cover is in the closed position; and an annular projection extending from a top surface of the cover; and a hinge coupled to the periphery of the body and the periphery of the cover, the hinge being configured so that the cover is pivotable about an axis generally tangent to the base between the closed position in which the dispensing aperture is closed and an open position in which matter may be dispensed through the dispensing aperture;

wherein the first element and the second element are configured to cooperate with one another to releasably retain the cover in the closed position; and wherein the cover extends radially outward over the indentation in the base of the body to provide a surface for facilitating the movement of the cover from the closed position to the open position.

14. The closure of claim 13 wherein the dispensing aperture is a plurality of dispensing apertures.

15. The closure of claim 14 wherein the projection extending from the bottom surface of the cover is a plurality of projections extending from the bottom surface of the cover.

16. The closure of claim 13 wherein the first contour corresponds to the second contour.

17. The closure of claim 16 wherein the first contour and the second contour are planar.

18. The closure of claim 13 wherein at least a portion of the top portion is flat.

19. The closure of claim 18 wherein at least a portion of the bottom surface of the cover is flat.

20. The closure of claim 13 wherein the hinge comprises a web extending between the cover and the body, the web including a generally curved upper edge and a generally curved lower edge.

21. The closure of claim 13 wherein the hinge is recessed within at least one of the body and the cover when the cover is in the closed position.

22. The closure of claim 13 wherein the bottom surface of the cover is adjacent the top portion of the body when the cover is in the closed position.

23. The closure of claim 13 wherein the first element is a first projection and the second element is a second projection and wherein the first projection and the second projection extend in opposite radial directions.

24. The closure of claim 23 wherein the first projection is configured to at least partially interfere with the second projection when the cover is moved into the closed position, and wherein the interference between the first projection and the second projection retains the cover in the closed position until the cover is opened by a user.

25. A closure for a container of a type including a receptacle having an open top and a closed bottom, the closure comprising:

a body comprising:

a base configured to be coupled to the receptacle;

a top portion coupled to the base, the top portion having a first contour, at least a portion of the first contour being non-planar;

a dispensing aperture in the top portion; and a recess extending around at least a portion of the periphery of the top portion; and a cover coupled to the body for movement between a closed position in which the dispensing aperture is closed and an open position in which the dispensing aperture is open, the cover comprising:

a bottom surface having a second contour; and a skirt extending downwardly from the bottom surface and configured to be received within the recess in the top portion when the cover is in the closed position.

26. The closure of claim 25 wherein the body further comprises an indentation near the recess.

27. The closure of claim 26 wherein the cover extends radially outward over the indentation and provides a surface to facilitate moving the cover from the closed position to the open position.

28. The closure of claim 25 further comprising a projection extending from the bottom surface of the cover and configured to extend into the dispensing aperture of the top portion when the cover is in the closed position.

29. The closure of claim 25 wherein the first contour corresponds to the second contour.

30. The closure of claim 25 wherein the first contour is substantially in the form of a truncated cone.

31. The closure of claim 25 wherein the first contour is substantially in the form of a dome.

32. The closure of claim 25 wherein the first contour is substantially in the form of a dome having an upper surface that is substantially planar.

33. The closure of claim 25 wherein at least a portion of the first contour and the second contour are curved.

34. The closure of claim 25 further comprising a hinge coupled to the body and the cover.

35. The closure of claim 34 wherein the hinge comprises a web extending between the cover and the body, the web including a generally curved upper edge and a generally curved lower edge.

36. The closure of claim 34 wherein the hinge is recessed within at least one of the body and the cover when the cover is in the closed position.

37. The closure of claim 25 further comprising a raised lip extending from the cover in a direction opposite the skirt.

38. The closure of claim 37 wherein the raised lip extends from an outer edge of the cover.

39. The closure of claim 25 further comprising a first element coupled to the body and a second element coupled to the cover, the first element and the second element being configured to cooperate with one another to releasably retain the cover in the closed position.

40. The closure of claim 39 wherein the second element is one of a projection and a corresponding recess configured to receive the projection and the first element is the other one of the projection and the recess.

41. The closure of claim 40 wherein the projection is at least two projections.

42. The closure of claim 41 wherein the recess is at least two recesses.

* * * * *